US007724915B2

(12) United States Patent
Matsumura et al.

(10) Patent No.: US 7,724,915 B2
(45) Date of Patent: May 25, 2010

(54) SPEAKER DEVICE

(75) Inventors: Toshiyuki Matsumura, Osaka (JP); Shuji Saiki, Nara (JP)

(73) Assignee: Panasonic Corporation, Osaka (JP)

( * ) Notice: Subject to any disclaimer, the term of this patent is extended or adjusted under 35 U.S.C. 154(b) by 282 days.

(21) Appl. No.: 10/594,573

(22) PCT Filed: Apr. 4, 2005

(86) PCT No.: PCT/JP2005/006613

§ 371 (c)(1),
(2), (4) Date: Sep. 27, 2006

(87) PCT Pub. No.: WO2005/099303

PCT Pub. Date: Oct. 20, 2005

(65) Prior Publication Data

US 2007/0274556 A1 Nov. 29, 2007

(30) Foreign Application Priority Data

Apr. 5, 2004 (JP) ..... 2004-110779

(51) Int. Cl.
*H04R 1/00* (2006.01)

(52) U.S. Cl. ..... 381/421; 381/412; 381/401

(58) Field of Classification Search ..... 381/412, 381/396, 421, 401, 152, 182
See application file for complete search history.

(56) References Cited

U.S. PATENT DOCUMENTS 4,607,382 A 8/1986 Dijkstra et al.
5,430,802 A 7/1995 Page
6,269,168 B1 * 7/2001 Tagami ..... 381/412
6,332,029 B1 * 12/2001 Azima et al. ..... 381/152
6,501,844 B2 * 12/2002 Proni ..... 381/403
6,574,346 B1 6/2003 Tanaka
6,658,133 B1 12/2003 Usuki et al.
6,735,322 B1 * 5/2004 Watanabe ..... 381/401
6,904,158 B1 * 6/2005 Ohashi ..... 381/401
2002/0136424 A1 9/2002 Usuki et al.

(Continued)

FOREIGN PATENT DOCUMENTS

EP 1 304 903 A2 4/2003

(Continued)

OTHER PUBLICATIONS

European Search Report issued Oct. 18, 2007 in European Application No. 05 72 8861.

*Primary Examiner*—Vivian Chin
*Assistant Examiner*—George C Monikang
(74) *Attorney, Agent, or Firm*—Wenderoth, Lind & Ponack, L.L.P.

(57) ABSTRACT

A speaker device that comprises a cabinet and a speaker unit. The speaker unit is attached to an opening portion formed in a front surface of the cabinet. The speaker unit has a back surface frame, a front surface frame, a first magnetic circuit, a second magnetic circuit, an edge, a damper, a diaphragm, a voice coil bobbin, and a voice coil. A non-magnet member which is a portion of the diaphragm, the first magnetic circuit, and the second magnetic circuit play a role as a negative stiffness mechanism to suppress an influence of an acoustic stiffness, thereby achieving a small-size speaker device capable of reproducing low-frequency sound.

17 Claims, 11 Drawing Sheets

U.S. PATENT DOCUMENTS

| | | | |
|---|---|---|---|
| 2003/0068063 | A1 | 4/2003 | Usuki et al. |

FOREIGN PATENT DOCUMENTS

| | | |
|---|---|---|
| GB | 1 419 111 | 12/1975 |
| GB | 2 083 974 | 3/1985 |
| JP | 59-207798 | 11/1984 |
| JP | 60-1998 | 1/1985 |
| JP | 61-16696 | 1/1986 |
| JP | 2000-308174 | 11/2000 |
| JP | 2001-231097 | 8/2001 |
| JP | 2002-112387 | 4/2002 |
| JP | 2003-87892 | 3/2003 |

* cited by examiner

SPEAKER DEVICE

TECHNICAL FIELD OF THE INVENTION

The present invention relates to a speaker device and, more particularly, to a speaker device which achieves low-frequency sound reproduction using a small-size cabinet.

BACKGROUND ART OF THE INVENTION

Conventionally, audio devices are becoming more digitalized, and players for reproducing music sources are becoming smaller and more portable. However, speaker devices for eventually reproducing sounds require large cabinets so as to sufficiently reproduce sounds in a low frequency region included in music sources. Therefore, speaker devices carried in the small-size or portable players have small-volume cabinets, so that an acoustic stiffness exhibited by the cabinet is large, and therefore, it is difficult to achieve low-frequency sound reproduction to a sufficient extent.

Therefore, a speaker device has been disclosed in which a limit of low-frequency sound reproduction which is determined by the volume of a cabinet is improved (see, for example, Patent Document 1). Hereinafter, the speaker device will be described with reference to FIG. 14. Note that FIG. 14 is a cross-sectional view of a structure of the speaker device.

In FIG. 14, the conventional speaker device comprises a cabinet 101 and a speaker unit 102. The speaker unit 102 has a frame 103, an edge 104, a cone-shaped diaphragm 105, a dust cap 106, a voice coil bobbin 107, a damper 108, a voice coil 109, a magnet 110, a center pole 111, a magnetic plate 112, a movable magnet 113, and a fixed magnet 114.

In FIG. 14, the speaker unit 102 is attached to an opening portion on a front surface of the cabinet 101. The magnet 110 is in the shape of a ring. A back surface of the magnet 110 (a surface of the magnet 110 closer to a back side of the cabinet 101) is fixed to a front side of the center pole 111. Aback surface of the magnetic plate 112 is fixed to a front surface of the magnet 110. The voice coil 109 is wound around an outer circumferential surface of an end portion of the voice coil bobbin 107 closer to the back side of the cabinet 101. The voice coil 109 is inserted in a magnetic gap formed between an outer circumferential surface of a convex of the center pole 111 and an inner circumferential surface of the magnetic plate 112. The frame 103 has a sound hole **103*h* and is fixed to a front surface of the magnetic plate 112. An outer circumference of the damper 108 is fixed to the frame 103 to support the voice coil bobbin 107. The cone-shaped diaphragm 105 is fixed to an end portion closer to the front surface of the voice coil bobbin 107. The edge 104, fixed to the flame 103, supports an outer circumference of the cone-shaped diaphragm 105. The dust cap 106 is fixed to a center portion of the cone-shaped diaphragm 105. The movable magnet 113 is in the shape of a ring, and an inner circumferential surface of the movable magnet 113 is fixed to the outer circumferential surface of the voice coil bobbin 107. The movable magnet 113 is disposed between the cone-shaped diaphragm 105 and the damper 108, in the voice coil bobbin 107. The fixed magnet 114 is in the shape of a ring, and an inner circumferential surface of the fixed magnet 114 faces an outer circumferential surface of the movable magnet 113, forming a gap. The movable magnet 113 and the fixed magnet 114** are magnetized to the same polarity in a thickness direction (vibration direction).

Next, an operation of the conventional speaker device thus configured will be described. When an electrical signal is applied to the voice coil 109, a driving force is generated. The cone-shaped diaphragm 105 fixed to the voice coil bobbin 107 is vibrated by the driving force. Sound is generated by the vibration of the cone-shaped diaphragm 105. The above-described operation is an operation of a typical electrokinetic speaker. The conventional speaker device largely differs from typical speakers in an interaction between the movable magnet 113 fixed to the outer circumferential surface of the voice coil bobbin 107, and the fixed magnet 114 disposed facing the movable magnet 113. The cone-shaped diaphragm 105 is vibrated by the driving force generated by the voice coil 109. In this case, the movable magnet 113 is vibrated together with the voice coil bobbin 107 inside of the fixed magnet 114. The movable magnet 113 and the fixed magnet 114 are magnetized to the same polarity in the vibration direction. Therefore, when the movable magnet 113 is displaced, a magnetic field in which the movable magnet 113 and the fixed magnet 114 repel each other is formed. Therefore, when the movable magnet 113 is displaced from a position where the movable magnet 113 and the fixed magnet 114 are magnetically balanced (hereinafter referred to as a balanced position), a force which allows the movable magnet 113 to escape from the balanced position acts on the movable magnet 113. Specifically, the movable magnet 113 and the fixed magnet 114 act to apply a negative stiffness to a vibration system of the speaker unit 102 at a position deviated from the balanced position. In other words, the movable magnet 113 and the fixed magnet 114 constitute a mechanism for generating a negative stiffness. Hereinafter, the mechanism for generating a negative stiffness is referred to as a negative stiffness generating mechanism.

The negative stiffness acts on the vibration system of the speaker unit 102 so that an acoustic stiffness of the cabinet 101 is reduced. As a result, a minimum resonant frequency of the speaker device decreases. In other words, in the conventional speaker device, even the small-size cabinet can reproduce low-frequency sound as if the speaker unit were mounted in a large-size cabinet.

Patent Document 1: Japanese Patent Laid-Open Publication No. 2000-308174

However, in the conventional speaker device, the movable magnet 113 which serves as a negative stiffness generating mechanism is provided in the voice coil bobbin 107. As a result, in the conventional speaker device, the weight of the vibration system of the speaker unit 102 increases, so that a level of an output sound pressure of the speaker unit 102 decreases.

In addition, if the size of the movable magnet 113 is reduced to decrease the weight of the vibration system, a magnetic field formed by the movable magnet 113 and the fixed magnet 114 is affected. Specifically, if the size of the movable magnet 113 is reduced, a force which gives the negative stiffness generated by the magnetic field decreases. Therefore, in the conventional speaker device, it is difficult to reduce the weight of the vibration system while keeping the force which gives the negative stiffness. Therefore, in order to increase the output sound pressure level of the speaker unit, it is conventionally necessary to reduce the weight of the vibration system and increase the driving force.

SUMMARY OF THE INVENTION

Therefore, an object of the present invention is to provide a small-size speaker device capable of reproducing low-frequency sound while securing an output sound pressure level without increasing a mass of a vibration system. Further, an object of the present invention is to provide a small-size speaker device capable of reproducing low-frequency sound while improving an output sound pressure level by enhancing a driving force, in addition to the above-described object.

A first aspect of the present invention is directed to a speaker device comprises a housing having an opening portion, a vibration system member for vibrating to generate sound, a support system member connected to the housing and for supporting the vibration system member in a manner which allows the vibration system member to vibrate, a first magnetic circuit provided inside the housing and having a first magnet disposed on a surface thereof facing the opening portion, and a first yoke provided lateral to the first magnet, and a second magnetic circuit having a second magnet disposed inside the housing and facing the first magnet via a gap, and a second yoke provided lateral to the second magnet. A magnetic gap is formed in at least one of an interval between a side surface of the first magnet and the first yoke in the first magnetic circuit and an interval between a side surface of the second magnet and the second yoke in the second magnetic circuit. The vibration system member includes a first voice coil, a first voice coil bobbin provided to dispose the first voice coil in the magnetic gap, and a non-magnet member made of a magnetic material which does not include a magnet, and connected directly or indirectly to the first voice coil bobbin so that the non-magnet member is disposed in the gap between the first magnet and the second magnet.

In a second aspect based on the first aspect, the vibration system member further includes a diaphragm at least a portion of which is composed of the non-magnet member. The first voice coil bobbin is fixed to the diaphragm. The support system member supports the diaphragm in the gap in a manner which allows the diaphragm to vibrate.

In a third aspect based on the first aspect, the second magnetic circuit further includes a magnetic plate fixed to a surface facing the opening portion of the second magnet, the second yoke disposed lateral to the second magnet and the magnetic plate, and forming a magnetic gap between the second magnet and a side surface of the magnetic plate, and forming a second gap between the second magnet and the magnetic plate. The vibration system member further includes a diaphragm disposed, facing a surface facing the opening portion of the housing of the second magnetic circuit. The first voice coil bobbin connects the diaphragm and the non-magnet member via the magnetic gap formed in the second magnetic circuit. The first voice coil is disposed in a magnetic gap formed in the second magnetic circuit.

In a fourth aspect based on the third aspect, the first magnetic circuit further includes a magnetic plate fixed to a surface facing inside of the housing of the first magnet. The first yoke is disposed lateral to the first magnet and the magnetic plate, to form a magnetic gap between the first magnet and a side surface of the magnet plate. The vibration system member further includes a second voice coil, and a second voice coil bobbin fixed to the non-magnet member and for disposing the second voice coil in the magnetic gap formed in the first magnetic circuit.

In a fifth aspect based on the first aspect, the second magnetic circuit further includes a magnetic plate fixed to a surface facing the opening portion of the second magnet. The second yoke is disposed lateral to the second magnet and the magnetic plate, and forms a magnetic gap between the second magnet and a side surface of the magnetic plate. The vibration system member further includes a diaphragm disposed, facing a surface facing the opening portion of the housing of the second magnetic circuit, and a connection member for connecting the diaphragm and the non-magnet member via the magnetic gap formed in the second magnetic circuit. The first voice coil bobbin disposes the first voice coil in the magnetic gap formed in the first magnetic circuit.

In a sixth aspect based on the first aspect, the first and second magnetic circuits have the same structure. The second magnetic circuit and the first magnetic circuit are arranged symmetrically about the non-magnet member.

In a seventh aspect based on the sixth aspect, the vibration system member further includes a second voice coil, and a second voice coil bobbin connected directly or indirectly to the non-magnet member and for disposing the second voice coil in the magnetic gap formed in the first magnetic circuit. The first voice coil bobbin disposes the first voice coil in the magnetic gap formed in the second magnetic circuit.

In an eighth aspect based on the first aspect, the first magnetic circuit further includes a magnetic plate fixed to a surface facing inside of the housing of the first magnet, and a third magnet fixed to a surface facing inside of the housing of the magnetic plate. The first yoke is provided to form a magnetic gap between the first yoke and a side surface of the magnetic plate. The first magnet and the third magnet are magnetized in directions opposite to each other, the directions being vibration directions of the vibration system member.

In a ninth aspect based on the first aspect, the second magnetic circuit further includes a magnetic plate fixed to a surface facing the opening portion of the housing of the second magnet, and a third magnet fixed to a surface facing the opening portion of the housing of the magnetic plate. The second yoke is provided to form a magnetic gap between the second yoke and a side surface of the magnetic plate. The second magnet and the third magnet are magnetized in directions opposite to each other, the directions being vibration directions of the vibration system member.

In a tenth aspect based on the first aspect, the first magnetic circuit further includes a magnetic plate fixed to a surface facing inside of the housing of the first magnet. The first yoke is provided to form a magnetic gap between the first yoke and a side surface of the magnetic plate. The first magnet is magnetized in a vibration direction of the vibration system member.

In an eleventh aspect based on the first aspect, the second magnetic circuit includes a magnetic plate fixed to a surface facing the opening portion of the second magnet. The second yoke is provided to form a magnetic gap between the second yoke and a side surface of the magnetic plate. The second magnet is magnetized in a vibration direction of the vibration system member.

In a twelfth aspect based on the first aspect, the speaker device comprises a plurality of magnetic circuit units each composed of the first and second magnetic circuits. The vibration system member includes the same number of the first voice coils as the number of the magnetic circuit units, the same number of the first voice coil bobbins as the number of the magnetic circuit units, each first voice coil being disposed in the magnetic gap of the corresponding magnetic circuit unit, and a diaphragm fixed to each first voice coil bobbin and at least a portion of which is composed of a non-magnet member.

In a thirteenth aspect based on the first aspect, the speaker device further comprises a position detecting section for detecting a position of the vibration system member, and a control section for controlling a vibration of the vibration system member by applying to the first voice coil a signal obtained by adding a direct current component to an acoustic signal based on the position of the vibration system member detected by the position detecting section so that a center of an amplitude of the non-magnet member is at a balanced position of a magnetic field formed in the gap.

In a fourteenth aspect based on the thirteenth aspect, the position detecting section is a laser displacement gauge.

In a fifteenth aspect based on the first aspect, the speaker device further comprises a frame fixed to the support system member. A speaker unit composed of the vibration system member, the support system member, the first and second magnetic circuits, and the frame, is attached to the opening portion by the frame being fixed to the opening portion.

A sixteenth aspect of the present invention is directed to a car comprising the speaker device according to any of claims 1 to 15, and a car body inside which the speaker device is disposed.

A seventeenth aspect of the present invention is directed to a video device comprising the speaker device according to any of claims 1 to 15, and a device housing inside which the speaker device is disposed.

According to the first aspect, a force is applied to the non-magnet member included in the vibration member in a direction in which the displacement of the non-magnet member is increased, due to a magnetic field formed in the gap between the first and second magnetic circuits. Therefore, when the non-magnet member is vibrated by the driving force of the voice coil, the amplitude of the non-magnet member is increased by the magnetic field in the gap. Thereby, the acoustic stiffness inside the housing is relaxed, so that even a small-size housing vibrates as if the housing volume were large, thereby making it possible to expand the limit of reproduction of a low-frequency sound band. Also, the force applied to the non-magnet member is generated by the magnetic field formed in the gap between the first and second magnetic circuits. In other words, even when a thickness of the non-magnet member is reduced to some extent, a sufficient force can be generated by the magnetic field formed in the gap between the first and second magnetic circuits. Therefore, a lightweight can be achieved by making the non-magnet member thinner while maintaining the force which relaxes the acoustic stiffness. Thereby, a reduction in the output sound pressure level of the speaker device can be suppressed. Also, by disposing the first voice coil in the gap formed in at least one of the first and second magnetic circuits, the vibration system member is vibrated. In other words, the first and second magnetic circuits can play a role in applying a force in a direction which extends the displacement of the non-magnet member due to the magnetic field formed by the first and second magnetic circuits, and a role in applying a driving force to the first voice coil. According to the first aspect, a single magnet can serve both as a magnet for applying a force to the non-magnet member, and a magnet for applying a driving force to the voice coil, thereby making it possible to reduce the number of parts in the speaker device.

According to the second aspect, since at least a portion of the diaphragm is composed of the non-magnet member, a force for extending the displacement of the non-magnet member can be transferred to the diaphragm with high efficiency.

According to the third aspect, since the first and second magnetic circuits are not disposed on a sound emitting surface of the diaphragm, reproduced sound quality having a satisfactory directivity can be provided.

According to the fourth aspect, since the first and second magnetic circuits are not disposed on a sound emitting surface of the diaphragm, reproduced sound quality having a satisfactory directivity can be provided. Also, since the vibration system member is driven by the first and second voice coils, the output sound pressure level of the speaker device can be improved.

According to the fifth aspect, since the first and second magnetic circuits are not disposed on a sound emitting surface of the diaphragm, reproduced sound quality having a satisfactory directivity can be provided.

According to the sixth aspect, in the gap between the first and second magnetic circuits, a symmetric magnetic field distribution is formed in the vibration direction with respect to the non-magnet member disposed in the gap. Therefore, a distortion due to the asymmetry of a magnetic field distribution can be reduced.

According to the seventh aspect, the first and second voice coils are disposed in the respective magnetic gaps formed in the first and second magnetic circuits, so that a driving force is generated from each voice coil, thereby making it possible to improve the output sound pressure level due to an increase in the driving force.

According to the eighth and ninth aspects, the first and second magnets and the third magnet are magnetized in directions opposite to each other, thereby making it possible to concentrate a larger amount of magnetic flux into the magnetic gap. Thereby, the output sound pressure level of the speaker device can be improved.

According to the tenth and eleventh aspects, the number of magnets included in the magnetic circuit can be reduced. Thereby, it is possible to reduce the size and weight of the speaker device.

According to the twelfth aspect, a plurality of magnetic circuit units are disposed, and the diaphragm is driven by each magnetic circuit unit, thereby making it possible to improve the output sound pressure level of the speaker device. In addition, by disposing the non-magnet members at positions which correspond to nodes of divided resonance of the diaphragm, the divided resonance can be suppressed even when the stiffness of the diaphragm is not increased, thereby making it possible to reduce a thickness of the speaker device. Also, by suppressing the divided resonance, the frequency characteristics of the output sound pressure of the speaker device can be made flat.

According to the thirteenth and fourteenth aspects, the non-magnet member is vibrated about the balanced position of the magnetic fields as a center, irrespective of a change in surrounding environments of the speaker device (e.g., a change in temperature, etc.), thereby making it possible to provide reproduced sound quality with a less distortion.

According to the fifth aspect, it is possible to achieve a speaker device comprising a housing for use in an AV system or the like, and the speaker unit.

According to the sixteenth aspect, it is possible to provide a car in which the speaker device is disposed in a car body.

According to the seventeenth aspect, it is possible to provide a video apparatus in which the speaker device ir disposed.

DESCRIPTION OF THE REFERENCE CHARACTERS

Figure 1:
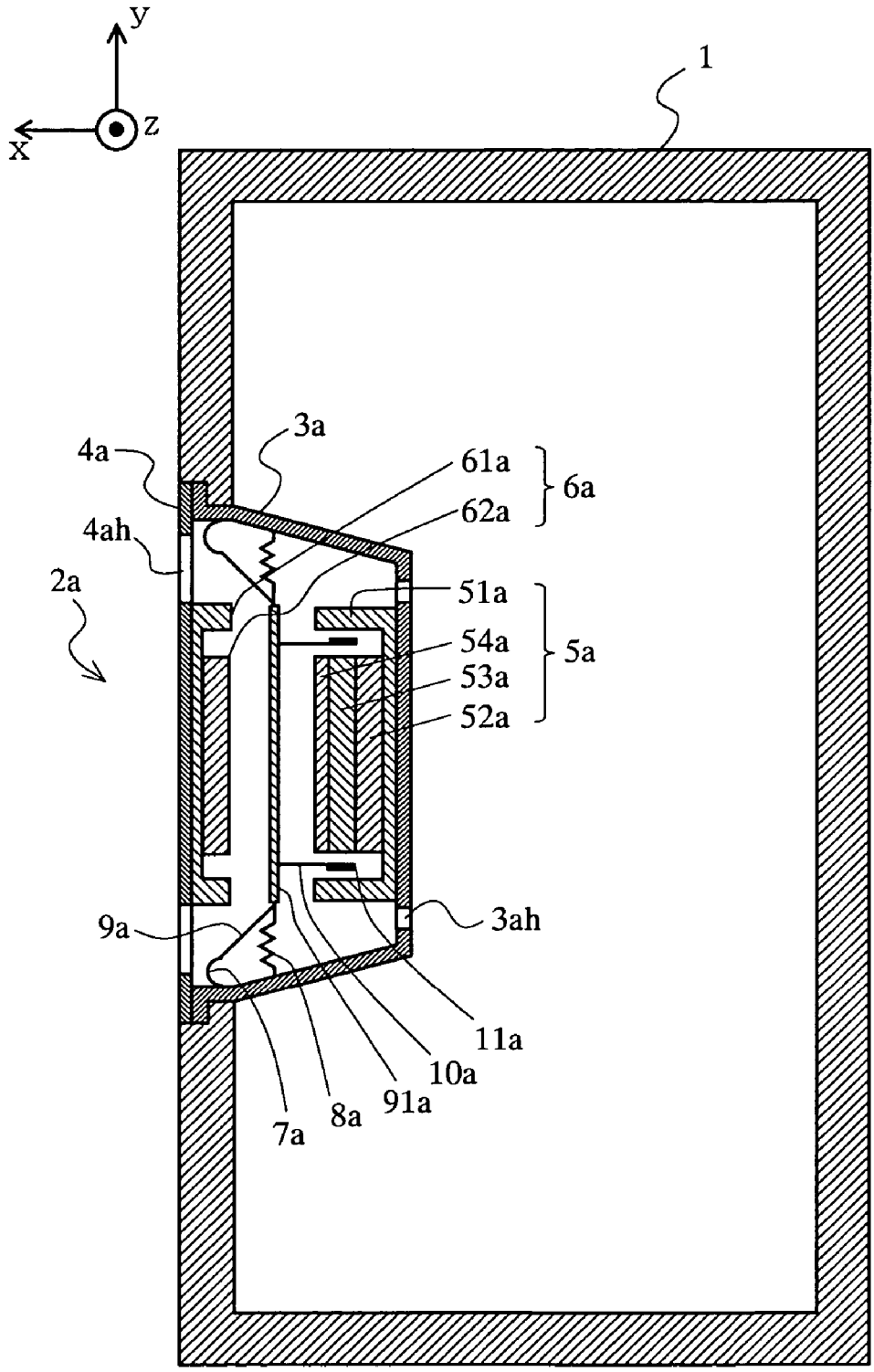
FIG. 1 is a cross-sectional view of a structure of a speaker device according to a first embodiment.

1, 26, 33 cabinet
2, 23, 28, 34 speaker unit
3 back surface frame
4 front surface frame
5 first magnetic circuit
6 second magnetic circuit
7 edge
8 damper
9 diaphragm
10, 12 voice coil bobbin
11, 13 voice coil
14 dust cap
15, 91 non-magnet member
16 column
17 arm
18 guide
19 laser displacement gauge
20 control circuit
21 window portion
22 door body
24 seat
25, 32 speaker device
27 pedestal
29 punching net
30 thin television main body
31 display
51, 61 yoke
52, 54, 62, 64 magnet
53, 63 magnetic plate
201 drive portion

DETAILED DESCRIPTION OF THE INVENTION

First Embodiment

A speaker device according to a first embodiment of the present invention will be described with reference to FIG. 1. FIG. 1 is a cross-sectional view of a structure of the speaker device of the first embodiment. In FIG. 1, the speaker device of the first embodiment roughly comprises a cabinet 1 and a speaker unit 2*a*. The speaker unit 2*a*, which is in the shape of, for example, a circle, is attached to an opening portion formed in a front surface (the positive direction of an x axis) of the cabinet 1. The cabinet 1 is a housing which gives an acoustic stiffness to the speaker unit 2*a*. The speaker unit 2*a* is composed of a back surface frame 3*a*, a front surface frame 4*a*, a first magnetic circuit 5*a*, a second magnetic circuit 6*a*, an edge 7*a*, a damper 8*a*, a diaphragm 9*a*, a voice coil bobbin 10*a*, and a voice coil 11*a*.

The back surface frame 3*a* has a shape in which an inner portion thereof is projected in the shape of a convex with respect to an outer circumferential portion thereof. The outer circumference of the back surface frame 3*a* is attached to the opening portion of the cabinet 1, and the back surface frame 3*a* is convex toward the inside of the cabinet 1. A sound hole 3*ah* which is in air communication with the inside of the cabinet 1, is formed in the back surface frame 3*a*. The front surface frame 4*a* is fixed to the outer circumferential portion of the back surface frame 3*a*. A sound hole 4*ah* for emitting sound forward is formed in the front surface frame 4*a*. The first magnetic circuit 5 is fixed to a center portion of a bottom surface (the inner portion) of the back surface frame 3*a*. The second magnetic circuit 6*a* is fixed to a center portion of a back surface (the negative direction of the x axis) of the front surface frame 4*a*, and is positioned, facing the first magnetic circuit 5*a* via a gap. The first and second magnetic circuits 5*a* and 6*a* have a cylindrical outer shape. The second magnetic circuit 6*a* is disposed at a position which allows a center axis thereof coincides with a center axis of the first magnetic circuit 5*a*. The diaphragm 9*a* is disposed in the gap between the first magnetic circuit 5*a* and the second magnetic circuit 6*a*. At least a portion of the diaphragm 9*a* is composed of a non-magnet member 91*a*. The voice coil bobbin 10*a* is a cylindrical member which is fixed to a side facing the first magnetic circuit 5*a* of the non-magnet member 91*a*. The voice coil 11*a* is wound around an outer circumferential surface of the voice coil bobbin 10*a*. An outer circumference of the edge 7*a* is fixed to the outer circumference of the back surface frame 3*a*. An inner circumference of the edge 7*a* is fixed to an outer circumference of the diaphragm 9*a*. Note that the diaphragm 9*a* and the edge 7*a* may be integrated together. An outer circumference of the damper 8*a* is fixed to the back surface frame 3*a*. An inner circumference of the damper 8*a* is fixed to the outer circumference of the diaphragm 9*a*. In the speaker unit 2*a*, the diaphragm 9*a*, the voice coil bobbin 10*a*, and the voice coil 11*a* are vibration system members which are vibrated by an input electrical signal. The edge 7*a* and the damper 8*a* are support system members which support the vibration system members in a manner which allows the non-magnet member 91*a* to vibrate in the gap between the first magnetic circuit 5*a* and the second magnetic circuit 6*a*.

The first magnetic circuit 5*a* has a yoke 51*a*, a first magnet 52*a*, a magnetic plate 53*a*, and a second magnet 54*a*. The yoke 51*a* has a cylindrical side surface, a bottom surface which is formed at one end of the side surface, and an opening at the other end. The bottom surface of the yoke 51*a* is fixed to a center portion of a bottom surface of the back surface frame 3*a*. The first magnet 52*a* is in the shape of a cylinder and is fixed to a center portion on a front surface of the yoke 51*a*. The magnetic plate 53*a* is in the shape of a cylinder and is fixed to a front surface of the first magnet 52*a*. The second magnet 54*a* is in the shape of a cylinder and is fixed to a front surface of the magnetic plate 53*a*. A gap is formed between an outer circumferential surface of each of the first magnet 52*a*, the magnetic plate 53*a*, and the second magnet 54*a*, and an inner cylindrical surface of the yoke 51*a*. In the gap, a magnetic gap is formed between the outer circumferential surface of the magnetic plate 53*a* and the inner circumferential surface of the yoke 51*a*. Note that the voice coil 11*a* is disposed in the magnetic gap, using the voice coil bobbin 10*a* fixed to the non-magnet member 91*a*. The first magnet 52*a* and the second magnet 54*a* are each magnetized in a vibration direction (an x-axis direction) of the diaphragm 9*a*. The magnetization directions of the first magnet 52*a* and the second magnet 54*a* are opposite to each other.

Here, a magnetic flux of the second magnet 54*a* passes via the magnetic plate 53*a* through the magnetic gap. Also, since the second magnet 54*a* is magnetized in a direction which causes the second magnet 54*a* to repel the first magnet 52*a*, the magnetic flux of the first magnet 52*a* passes through the magnetic gap in a further concentrated manner. In other words, the second magnet 54*a* increases the magnetic flux density in the magnetic gap to increase a driving force of the voice coil 11*a*.

The second magnetic circuit 6*a* has a yoke 61*a* and a magnet 62*a*. The yoke 61*a* has a cylindrical side surface, a bottom surface which is formed at one end of the side surface, and an opening at the other end. The bottom surface of the yoke 61*a* is fixed to a center portion of a back surface of the front surface frame 4*a*. The magnet 62*a* is in the shape of a cylinder and is fixed to a center portion of a back surface of the yoke 61*a*. Here, a gap is formed between an outer circumferential surface of the magnet 62*a* and an inner circumferential surface of the yoke 61*a*, as in the first magnetic circuit 5*a*. Note that the magnet 62*a* is magnetized in the vibration direction of the diaphragm 9*a*. The magnetization direction of the magnet 62*a* may be the same as or opposite to that of the second magnet 54*a*.

At least a portion of the diaphragm 9*a* is composed of the non-magnet member 91*a*. The non-magnet member 91*a* is a magnetic material other than magnets. Examples of the non-magnet member 91*a* include magnetic materials, such as iron, permalloy, and the like, which do not have as strong a coercive force as that of magnets. The non-magnet member 91*a* may be disposed in a gap between the first and second magnetic circuits. Therefore, for example, an entire surface of the diaphragm 9*a* may be composed of the non-magnet member 91*a*. An area obtained by projecting the gap formed between the first and second magnetic circuits perpendicularly onto the diaphragm 9*a* is in the shape of a ring. A magnetic field in the vicinity of the ring-shaped area can generate a repelling force (described below) most strongly with respect to the non-magnet member 91*a*. Therefore, the ring-shaped area of the diaphragm 9*a* is preferably composed of the non-magnet member 91*a*. Also, for example, a portion of the diaphragm 9*a* corresponding to the circular shape of the yoke 51*a* or the yoke 61*a* may be composed of the non-magnet member 91*a*. Note that, as a specific exemplary structure of the diaphragm 9*a* and the non-magnet member 91*a*, the plate-shaped non-magnet member 91*a* may be joined onto both or either of the surfaces of the non-magnetic material diaphragm 9*a*.

Next, an operation of the speaker device of this embodiment will be described. When an electrical signal is applied to the voice coil 11*a*, a driving force is generated by a current flowing through the voice coil 11*a* and a magnetic field formed in the magnetic gap. The driving force vibrates the diaphragm 9*a* to generate sound. This is a basic operation of an electrokinetic speaker.

The diaphragm 9*a*, at least a portion of which is composed of the non-magnet member 91*a*, vibrates in the gap between the first magnetic circuit 5*a* and the second magnetic circuit 6*a*. The vibration direction of the diaphragm 9*a* is the front-to-back surface direction (the x-axis direction). In this case, pulling forces in the vibration direction are alternately applied to the non-magnet member 91*a* by the magnetic field formed by the first and second magnetic circuits, depending on the vibration of the diaphragm 9*a*. For example, when the diaphragm 9*a* is displaced closer to the first magnetic circuit 5*a*, a force is applied to the non-magnet member 91*a* by the magnetic field formed by the first and second magnetic circuits in a direction which increases the displacement. The pulling forces applied to the non-magnet member 91*a* by the magnetic field formed by the first and second magnetic circuits are balanced between the first magnetic circuit 5*a* and the second magnetic circuit 6*a*. Hereinafter, a position in the gap where the pulling forces are balanced is referred to as a balanced position. The diaphragm 9*a* vibrates while the non-magnet member 91*a* receives a repelling force in a direction which causes the non-magnet member 91*a* to go away from the balanced position by the magnetic filed formed by the first and second magnetic circuits.

On the other hand, the acoustic stiffness of an empty room enclosed by the cabinet 1, the diaphragm 9*a*, and the edge 7*a* suppresses the vibration of the diaphragm 9*a* using the spring force. The spring force increases with a decrease in volume of the empty room. Also, the larger the spring force, the more significantly the vibration of the diaphragm 9*a* is suppressed. In contrast to this, the repelling force generated by the magnetic field formed by the first and second magnetic circuits, acts in a direction which cancels the spring force received by the acoustic stiffness. In other words, the repelling force acts as a negative stiffness which reduces the acoustic stiffness. Thus, the non-magnet member 91*a* of the diaphragm 9*a*, the first magnetic circuit 5*a*, and the second magnetic circuit 6*a* play a role as a mechanism for generating a negative stiffness (negative stiffness generating mechanism). Thereby, the suppression by the acoustic stiffness is relaxed, so that the diaphragm 9*a* becomes easy to vibrate. The diaphragm 9*a* operates as if the cabinet volume were large, so that the minimum resonant frequency of the speaker unit 2*a* is reduced. As a result, the limit of low-frequency sound reproduction can be expanded.

As described above, the negative stiffness generating mechanism relaxes the influence of the acoustic stiffness of the empty room enclosed by the cabinet 1, the diaphragm 9*a*, and the edge 7*a*. Thereby, the speaker device of this embodiment, even in the case of a small-size cabinet, operates as if the cabinet volume were large, so that the limit of low-frequency sound reproduction can be expanded.

Also, in the negative stiffness generating mechanism, a repelling force is applied to the non-magnet member 91*a* by the magnetic field formed by the first and second magnetic circuits. Therefore, in the structure, even when a thickness of the non-magnet member 91*a* is reduced to some extent, a sufficient level of repelling force can be generated with respect to the non-magnet member 91*a*. Therefore, in this embodiment, the non-magnet member 91*a* joined with the diaphragm 9*a* can be made thin, so that the weight of the vibration system can be significantly reduced as compared to a conventional speaker device which employs the movable magnet 113. As a result, in the speaker device of this embodiment, it is possible to suppress a reduction in the output sound pressure level of the speaker unit 2*a*.

The first magnetic circuit 5*a* plays a role as an electrokinetic converter, and the negative stiffness generating mechanism shares a portion of the first magnetic circuit 5*a*. Thereby, the speaker device of this embodiment can suppress the size due to an increase in volume of a magnet, labor cost, and price cost, as compared to when all magnetic circuits constituting a negative stiffness generating mechanism are newly provided.

Figure 2:
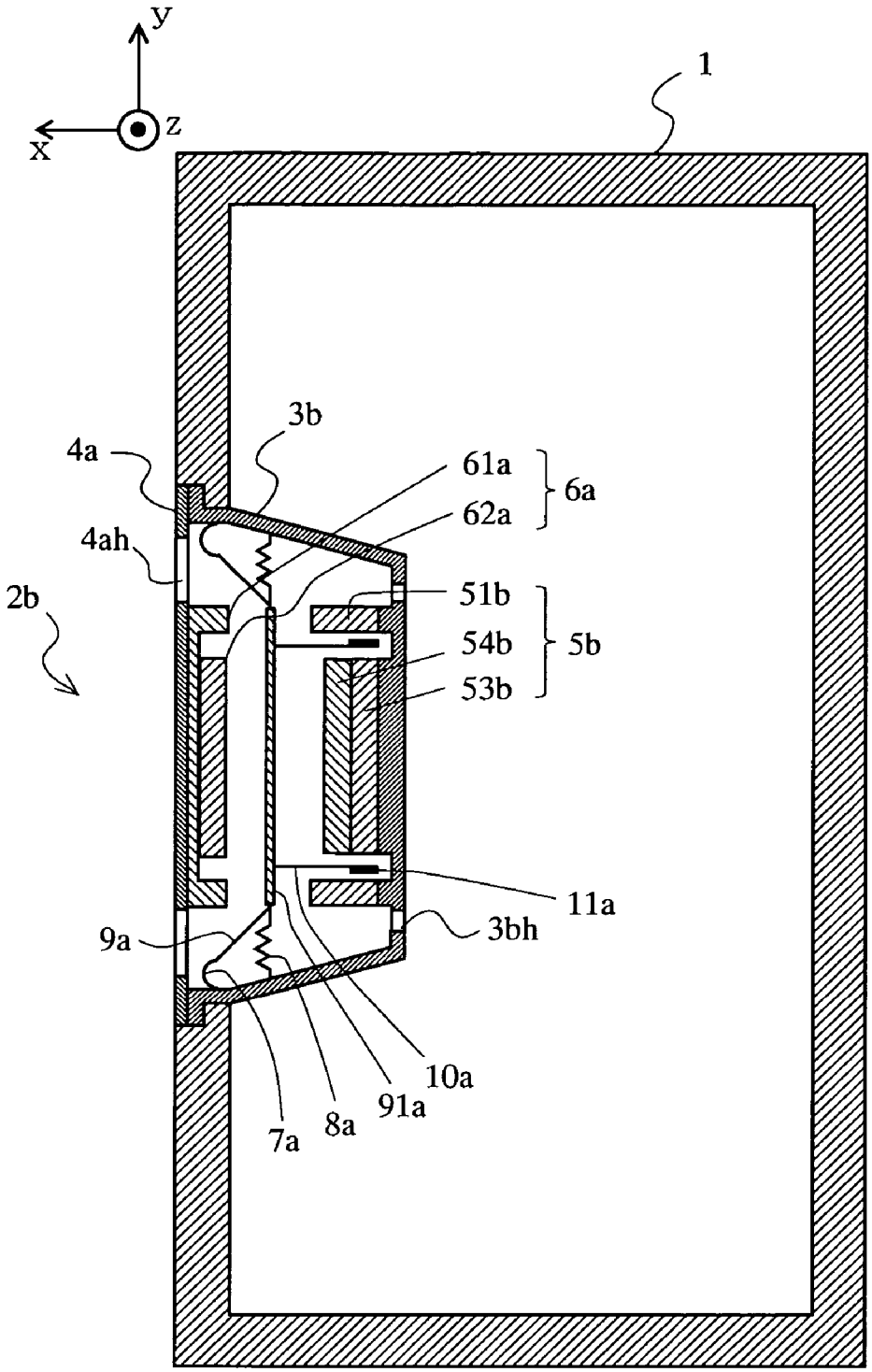
FIG. 2 is a cross-sectional view illustrating a structure of a speaker device which employs a speaker unit 2*b* composed of a first magnetic circuit 5*b*.

Note that the above-described first magnetic circuit 5*a* may be a first magnetic circuit 5*b* of FIG. 2. FIG. 2 is a cross-sectional view illustrating a structure of a speaker device which employs a speaker unit 2*b* composed of the first magnetic circuit 5*b*. In FIG. 2, a front surface frame 3*b* is different from the above-described front surface frame 3*a* only in a shape of a center portion thereof to which the first magnetic circuit 5*b* is fixed. The first magnetic circuit 5*b* is fixed to a center portion of a bottom surface of the back surface frame 3*b*.

The first magnetic circuit 5*b* has a yoke 51*b*, a magnet 54*b*, and a magnetic plate 53*b*. The magnetic plate 53*b* is in the shape of a cylinder, and is fixed to the center portion of the bottom surface of the back surface frame 3*b*. The magnet 54*b* is in the shape of a cylinder, and is fixed to a front surface of the magnetic plate 53*b*. A magnetic gap is formed between an outer circumferential surface of the magnetic plate 53*b* and an inner circumferential surface of the yoke 51*b*. Note that the magnet 54*b* is magnetized in a vibration direction of a diaphragm 9*a*. The magnet 52*b* may have a magnetization direction the same as or opposite to that of the magnet 62*a*. The yoke 51*d* is in the shape of a ring, and is fixed to the bottom surface of the back surface frame 3*b* so that the magnetic plate 53*b* and the magnet 54*b* are disposed in an inner circumference thereof. In FIG. 2, the first magnetic circuit 5*b*, the second magnetic circuit 6*a*, and the non-magnet member 91*a* play a role as a negative stiffness generating mechanism.

As described above, the above-described first magnetic circuit 5*a* may be replaced with the first magnetic circuit 5*b* of FIG. 2. In this case, the speaker unit 2*b* can have a smaller number of magnets, and therefore, has an advantage in terms of cost.

Note that, in FIG. 1, the positions of the first magnetic circuit 5*a* and the second magnetic circuit 6*a* may be switched. In this case, the voice coil bobbin 10*a* is fixed to the front surface of the non-magnet member 91*a*, and the voice coil is disposed in the magnetic gap of the first magnetic circuit 5*a*. Similarly, in FIG. 2, the positions of the first magnetic circuit 5*b* and the second magnetic circuit 6*a* may be switched. Although the speaker units 2*a* and 2*b* are in the shape of, for example, a circle in the above description, the speaker units 2*a* and 2*b* may have other shapes, such as an elliptical shape, a rectangular shape, an elongate shape, or the like. Alternatively, the speaker units 2*a* and 2*b* may be in the shape of a racetrack in which only two opposite sides of a rectangle are replaced with semicircles (hereinafter referred to as a track shape). The shapes of the magnets, the yokes, the magnetic plates, and the diaphragms included in the speaker units 2*a* and 2*b* may be set as appropriate so as to fit the shapes of the speaker units 2*a* and 2*b*. For example, when the speaker unit is in the shape of a rectangle, the diaphragm may be in the shape of a rectangle, and the magnet may be in the shape of a rectangular prism.

Second Embodiment

Figure 3:
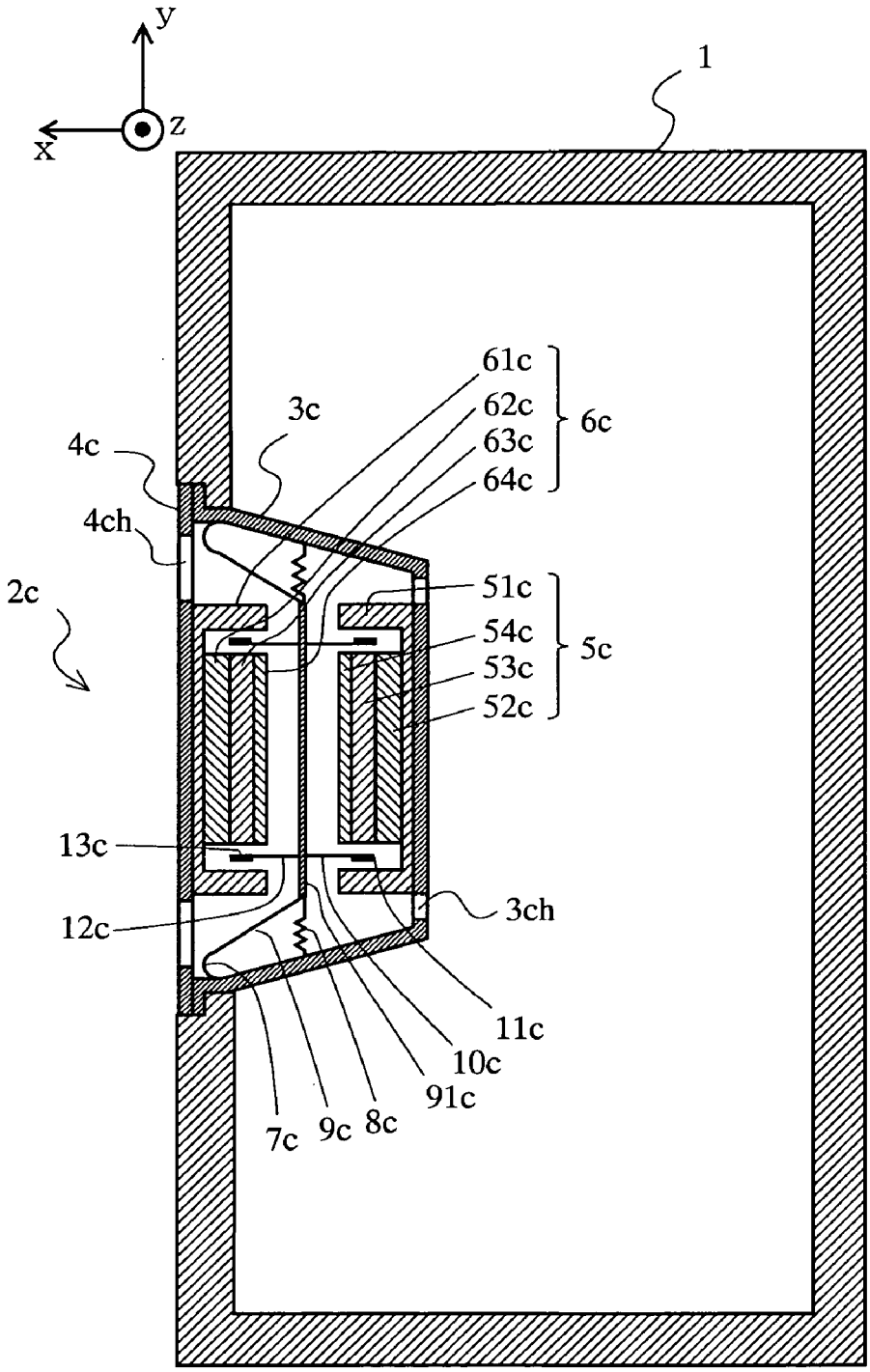
FIG. 3 is a cross-sectional view of a structure of a speaker device according to a second embodiment.

A speaker device according to a second embodiment of the present invention will be described with reference to FIG. 3. FIG. 3 is a cross-sectional view of a structure of the speaker device of the second embodiment. In FIG. 3, the speaker device of the second embodiment roughly comprises a cabinet 1 and a speaker unit 2*c*. The speaker unit 2*c*, which is in the shape of, for example, a circle, is attached to an opening portion formed in a front surface (the positive direction of an x axis) of the cabinet 1. The cabinet 1 is a housing which gives an acoustic stiffness to the speaker unit 2*c*. The speaker unit 2*c* is different from the speaker unit 2*a* of the first embodiment in that both the first and second magnetic circuits both form magnetic gaps, and two voice coil bobbins and two voice coils are provided. Hereinafter, a structure of the speaker unit 2*c* will be described.

The speaker unit 2*c* is composed of a back surface frame 3*c*, a front surface frame 4*c*, a first magnetic circuit 5*c*, a second magnetic circuit 6*c*, an edge 7*c*, a damper 8*c*, a diaphragm 9*c*, a first voice coil bobbin 10*c*, a first voice coil 11*c*, a second voice coil bobbin 12*c*, and a second voice coil 13*c*.

The back surface frame 3*c* has a shape in which an inner portion thereof is projected in the shape of a convex with respect to an outer circumferential portion thereof. The outer circumference of the back surface frame 3*c* is attached to the opening portion of the cabinet 1, and the back surface frame 3*c* is convex toward the inside of the cabinet 1. A sound hole 3*ch* which is in air communication with the inside of the cabinet 1, is formed in the back surface frame 3*c*. The front surface frame 4*c* is fixed to the outer circumferential portion of the back surface frame 3*c*. A sound hole 4*ch* for emitting sound forward is formed in the front surface frame 4*c*. The first magnetic circuit 5*c* is fixed to a center portion of a bottom surface (the inner portion) of the back surface frame 3*c*. The second magnetic circuit 6*c* is fixed to a center portion of a back surface (the negative direction of an x axis) of the front surface frame 4*c*, and is positioned, facing the first magnetic circuit 5*c* via a gap. The first and second magnetic circuits 5*c* and 6*c* have a cylindrical outer shape. The second magnetic circuit 6*c* is disposed at a position which allows a center axis thereof coincides with a center axis of the first magnetic circuit 5*c*. The diaphragm 9*c* is disposed in the gap between the first magnetic circuit 5*c* and the second magnetic circuit 6*c*. At least a portion of the diaphragm 9*c* is composed of a non-magnet member 91*c*. The first voice coil bobbin 10*c* is a cylindrical member which is fixed to a surface facing the first magnetic circuit 5*c* of the non-magnet member 91*c*. The first voice coil 11*c* is wound around an outer circumferential surface of the first voice coil bobbin 10*c*. The second voice coil bobbin 12*c* is a cylindrical member which is fixed to a surface facing the second magnetic circuit 6*c* of the non-magnet member 91*c*. The second voice coil 13*c* is wound around an outer circumferential surface of the second voice coil bobbin 12*c*. An outer circumference of the edge 7*c* is fixed to an outer circumference of the back surface frame 3*c*. An inner circumference of the edge 7*c* is fixed to an outer circumference of the diaphragm 9*c*. Note that the diaphragm 9*c* and the edge 7*c* may be integrated together. An outer circumference of the damper 8*c* is fixed to the back surface frame 3*c*. An inner circumference of the damper 8*c* is fixed to the outer circumference of the diaphragm 9*c*. In the speaker unit 2*c*, the diaphragm 9*c*, the first and second voice coil bobbins, and the first and second voice coils are vibration system members which are vibrated by an input electrical signal. The edge 7*c* and the damper 8*c* are support system members which support the vibration system members in a manner which allows the non-magnet member 91*c* to vibrate in the gap between the first magnetic circuit 5*c* and the second magnetic circuit 6*c*.

The first magnetic circuit 5*c* has a yoke 51*c*, a first magnet 52*c*, a magnetic plate 53*c*, and a second magnet 54*c*. The yoke 51*c* has a cylindrical side surface, a bottom surface which is formed at one end of the side surface, and an opening at the other end. A bottom surface of the yoke 51*c* is fixed to the center portion of the bottom surface of the back surface frame 3*c*. The first magnet 52*c* is in the shape of a cylinder and is fixed to a center portion of a front surface of the yoke 51*c*. The magnetic plate 53*c* is in the shape of a cylinder and is fixed to a front surface of the first magnet 52*c*. The second magnet 54*c* is in the shape of a cylinder and is fixed to a front surface of the magnetic plate 53*c*. A gap is formed between an outer circumferential surface of each of the first magnet 52*c*, the magnetic plate 53*c*, and the second magnet 54*c*, and an inner cylindrical surface of the yoke 51*c*. In the gap, a magnetic gap is formed between the outer circumferential surface of the magnetic plate 53*c* and the inner circumferential surface of the yoke 51*c*. Note that the first voice coil 11*c* is disposed in the magnetic gap formed in the first magnetic circuit 5*c*, using the first voice coil bobbin 10*c* fixed to the non-magnet member 91*c*. The first magnet 52*c* and the second magnet 54*c* are each magnetized in a vibration direction (an x-axis direction) of the diaphragm 9*c*. The magnetization directions of the first magnet 52*c* and the second magnet 54*c* are opposite to each other.

Here, a magnetic flux of the second magnet 54*c* passes via the magnetic plate 53*c* through the magnetic gap. Also, since the second magnet 54*c* is magnetized in a direction which causes the second magnet 54*c* to repel the first magnet 52*c*, the magnetic flux of the first magnet 52*c* passes through the magnetic gap in a further concentrated manner. In other words, the second magnet 54*c* plays a role in increasing the magnetic flux density in the magnetic gap to increase a driving force of the first voice coil 11*c*.

The second magnetic circuit 6*c* has a yoke 61*c*, a first magnet 62*c*, a magnetic plate 63*c*, and a second magnet 64*c*. The yoke 61*c* has a cylindrical side surface, a bottom surface which is formed at one end of the side surface, and an opening at the other end. The bottom surface of the yoke 61*c* is fixed to a center portion of a back surface of the front surface frame 4*c*. The first magnet 62*c* is in the shape of a cylinder and is fixed to a center portion of a back surface of the yoke 51*c*. The magnetic plate 63*c* is in the shape of a cylinder and is fixed to a back surface of the first magnet 62*c*. The second magnet 64*c* is in the shape of a cylinder and is fixed to a back surface of the magnetic plate 63*c*. Here, as is similar to the first magnetic circuit 5*c*, a gap is formed between an outer circumferential surface of each of the first magnet 62*c*, the magnetic plate 63*c* and the second magnet 64*c*, and an inner circumferential surface of the yoke 61*c*. A magnetic gap is formed in the gap between the outer circumferential surface of the magnetic plate 63*c* and the yoke 61*c*. Note that the second voice coil 21 is disposed in the magnetic gap formed in the second magnetic circuit 6*c*, using the second voice coil bobbin 12*c* fixed to the non-magnet member 91*c*. The first magnet 62*c* and the second magnet 64*c* are each magnetized in a vibration direction of the diaphragm 9*c*. The magnetization directions of the first magnet 62*c* and the second magnet 64*c* are opposite to each other. Note that the second magnet 64*c* enhances the driving force of the second voice coil 13*c* as with the above-described second magnet 54*c*.

Here, the magnetization directions of the second magnet 54*c* and the second magnet 64*c*, and the winding directions of the first and second voice coils, will be described. When the second magnet 54*c* and the second magnet 64*c* are caused to have the same magnetization direction, the winding directions of the first and second voice coils are set to be opposite to each other. When the magnetization direction of the second magnet 54*c* and the second magnet 64*c* are caused to be opposite to each other, the winding directions of the first and second voice coils are set to be the same. Thereby, when a current is applied to the first and second voice coils, driving forces are obtained in the same direction.

As is similar to the first embodiment above, at least a portion of the diaphragm 9*c* is composed of the non-magnet member 91*c*. The non-magnet member 91*c* is a magnetic material other than magnets. The position of the non-magnet member 91*c* and the structure of the diaphragm 9*c* are similar to those of the diaphragm 9*a* and the non-magnet member 91*a* of the first embodiment above and will not be described.

Next, an operation of the speaker device of this embodiment will be described. When an electrical signal is applied to the first voice coil 11*c* and the second voice coil 13*c*, a current flows through each voice coil and a magnetic field is formed in each magnetic gap, so that a driving force is generated in each voice coil in the same direction. Each driving force vibrates the diaphragm 9*c*, thereby generating sound.

The diaphragm 9*c*, at least a portion of which is composed of the non-magnet member 91*c*, vibrates in the gap between the first magnetic circuit 5*c* and the second magnetic circuit 6*c*. The vibration direction of the diaphragm 9*c* is the front-to-back surface direction (the x-axis direction). In this case, pulling forces in the vibration direction are alternately applied to the non-magnet member 91*c* by the magnetic field formed by the first and second magnetic circuits, depending on the vibration of the diaphragm 9*c*. In other words, in this embodiment, the non-magnet member 91*c*, the first magnetic circuit 5*c*, and the second magnetic circuit 6*c* play a role as a negative stiffness generating mechanism. Note that the negative stiffness generating mechanism is similar to that of the first embodiment above and will not be described. By the negative stiffness generating mechanism, the suppression by the acoustic stiffness of the empty room enclosed by the cabinet 1, the diaphragm 9*c*, and the edge 7*c* is relaxed, so that the diaphragm 9*c* becomes easy to vibrate. The diaphragm 9*c* operates as if the cabinet volume were large, so that the minimum resonant frequency of the speaker unit 2*c* is reduced. As a result, the limit of low-frequency sound reproduction can be expanded.

As described above, the negative stiffness generating mechanism relaxes the influence of the acoustic stiffness of the empty room enclosed by the cabinet 1, the diaphragm 9*c*, and the edge 7*c*. Thereby, the speaker device of this embodiment, even in the case of a small-size cabinet, operates as if the cabinet volume were large, so that the limit of low-frequency sound reproduction can be expanded.

In the speaker unit 2*c* of this embodiment, a driving force is generated in each of the first and second voice coils, so that the driving force is increased as compared to the first embodiment. As a result, in this embodiment, the output sound pressure level can be further improved.

In the speaker unit 2*c* of this embodiment, the first and second magnetic circuits are symmetric about the non-magnet member 91*c*. Thereby, in the gap between the first and second magnetic circuits, a symmetric magnetic field distribution is formed in the vibration direction from the balanced position of the gap. Therefore, a distortion due to the asymmetry of a magnetic field distribution can be reduced.

Figure 4:
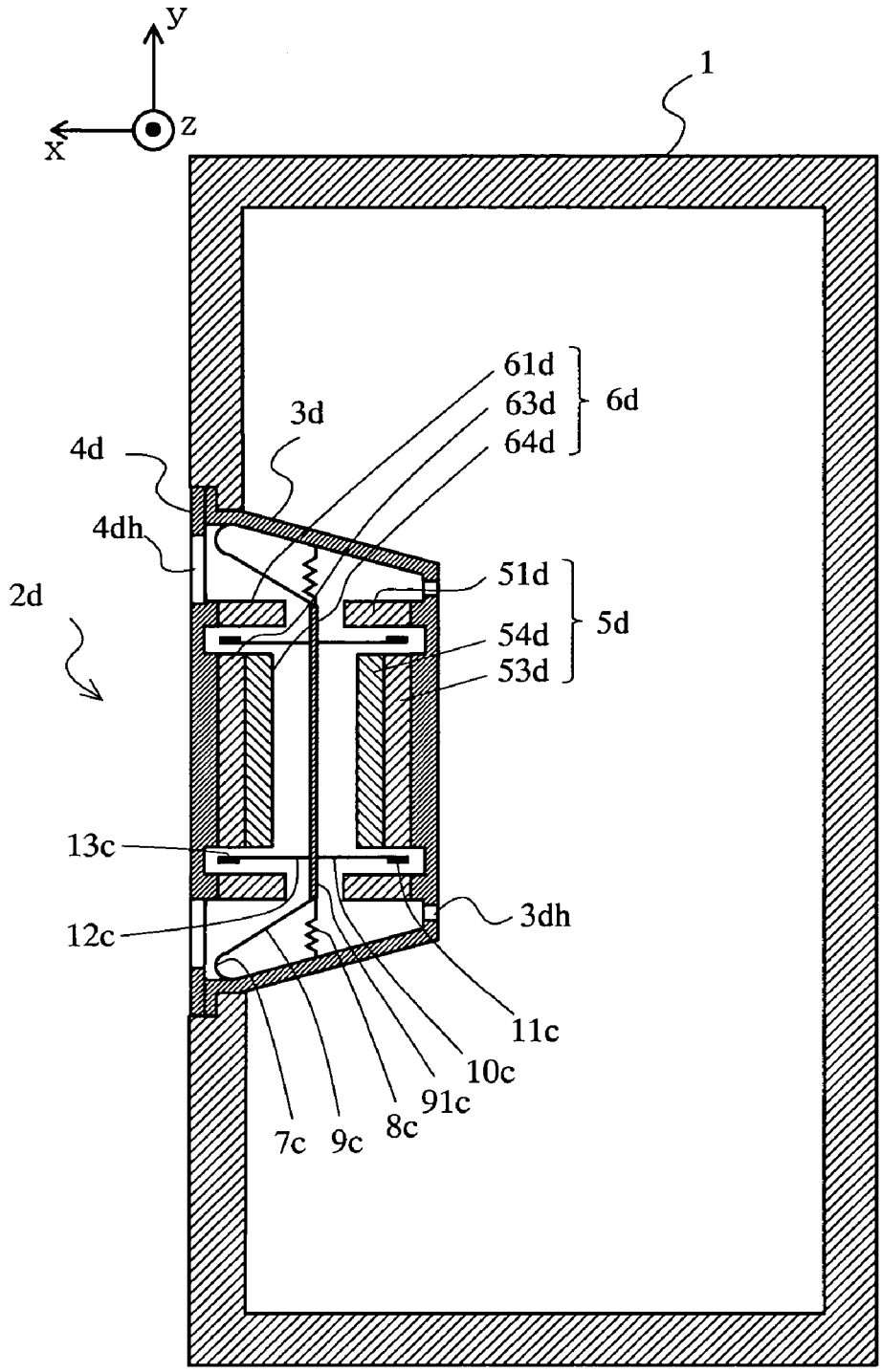
FIG. 4 is a cross-sectional view illustrating a structure of a speaker device which employs a speaker unit 2*d* composed of a first magnetic circuit 5*d* and a second magnetic circuit 6*d*.

Note that, as in the first embodiment, the above-described first and second magnetic circuits may be a first magnetic circuit 5*d* and a second magnetic circuit 6*d* of FIG. 4, respectively. FIG. 4 is a cross-sectional view illustrating a structure of a speaker device which employs a speaker unit 2*d* composed of the first magnetic circuit 5*d* and the second magnetic circuit 6*d*. In FIG. 4, a front surface frame 4*d* is different from the front surface frame 4*a* only in a shape of a center portion thereof to which the second magnetic circuit 6*d* is fixed. A back surface frame 3*d* is different from the above-described back surface frame 3*c* only in a shape of a center portion thereof to which the first magnetic circuit 5*d* is fixed. The first magnetic circuit 5*d* is fixed to a center portion of a bottom surface of the back surface frame 3*d*. The second magnetic circuit 6*d* is fixed to a center portion of a back surface of the front surface frame 4*d*.

The first magnetic circuit 5*d* has a yoke 51*d*, a magnet 54*d*, and a magnetic plate 53*d*. The magnetic plate 53*d* is in the shape of a cylinder, and is fixed to the center portion of the bottom surface of the back surface frame 3*d*. The magnet 54*d* is in the shape of a cylinder, and is fixed to a front surface of the magnetic plate 53*d*. The yoke 51*d* is in the shape of a ring, and is fixed to the bottom surface of the back surface frame 3*d* so that the magnetic plate 53*d* and the magnet 54*d* are disposed in an inner circumference thereof. A magnetic gap is formed between an outer circumferential surface of the magnetic plate 53*d* and an inner circumferential surface of the yoke 51*d*. Note that the magnet 54*d* is magnetized in a vibration direction of a diaphragm 9*c*.

The second magnetic circuit 6*d* has a yoke 61*d*, a magnet 64*d*, and a magnetic plate 63*d*. The magnetic plate 63*d* is in the shape of a cylinder, and is fixed to a center portion of a back surface of the front surface frame 4*d*. The magnet 64*d* is in the shape of a cylinder, and is fixed to a back surface of the magnetic plate 63*d*. The yoke 61*d* is in the shape of a ring, and is fixed to the back surface of the front surface frame 4*d* so that the magnetic plate 63*d* and the magnet 64*d* are disposed in an inner circumference thereof. A magnetic gap is formed between an outer circumferential surface of the magnetic plate 63*d* and an inner circumferential surface of the yoke 61*d*. Note that the magnet 64*d* is magnetized in a vibration direction of the diaphragm 9*c*. In FIG. 4, the first magnetic circuit 5*d*, the second magnetic circuit 6*d*, and the non-magnet member 91*c* play a role as a negative stiffness generating mechanism.

As described above, the first and second magnetic circuits may be the first magnetic circuit 5*d* and the second magnetic circuit 6*d* of FIG. 4. In this case, the speaker unit 2*d* has a smaller number of magnet components, and therefore, has an advantage in terms of cost, as compared to the speaker unit 2*c*.

Although the speaker units 2*c* and 2*d* are in the shape of, for example, a circle in the above description, the speaker units 2*c* and 2*d* may have other shapes, such as an elliptical shape, a track shape, a rectangular shape, an elongate shape, or the like. The shapes of the parts (e.g., a magnet, etc.) included in each speaker unit are similar to those of the first embodiment above.

Third Embodiment

Figure 5:
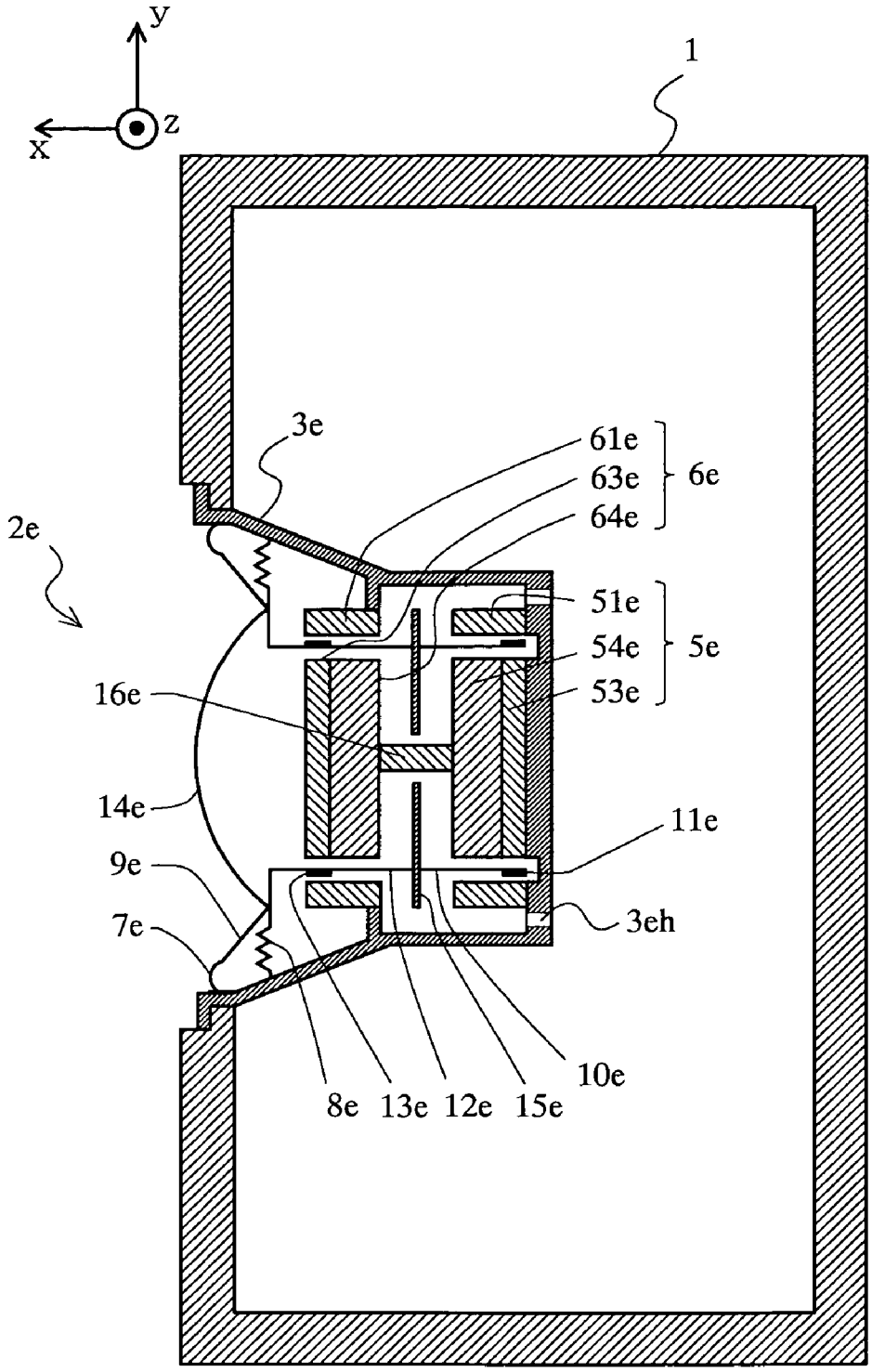
FIG. 5 is a cross-sectional view of a structure of a speaker device according to a third embodiment.

A speaker device according to a third embodiment of the present invention will be described with reference to FIG. 5. FIG. 5 is a cross-sectional view of a structure of the speaker device of the third embodiment. In FIG. 5, the speaker device of the third embodiment roughly comprises a cabinet 1 and a speaker unit 2*e*. The speaker unit 2*e*, which is in the shape of, for example, a circle, is attached to an opening portion formed in a front surface (the positive direction of an x axis) of the cabinet 1. The cabinet 1 is a housing which gives an acoustic stiffness to the speaker unit 2*e*. The speaker unit 2*e* is different from the speaker unit 2*c* of the second embodiment in that a second magnetic circuit is supported by a column disposed in a gap between the second magnetic circuit and a first magnetic circuit, so that the front surface frame is no longer required, and an outer appearance thereof is similar to that of conventional speaker units, and that a magnetic material does not form a portion of a diaphragm and is fixed to a voice coil bobbin. Hereinafter, a structure of the speaker unit 2*e* will be described.

The speaker unit 2*e* is composed of a back surface frame 3*e*, a first magnetic circuit 5*e*, a second magnetic circuit 6*e*, an edge 7*e*, a damper 8*e*, a diaphragm 9*e*, a first voice coil bobbin 10*e*, a first voice coil 11*e*, a second voice coil bobbin 12*e*, a second voice coil 13*e*, a non-magnet member 15*e*, and a column 16*e*.

The back surface frame 3*e* has a shape in which an inner portion thereof is projected in the shape of a convex with respect to an outer circumferential portion thereof. The outer circumference of the back surface frame 3*e* is attached to an opening portion of the cabinet 1, and the back surface frame 3*e* is convex toward the inside of the cabinet 1. A sound hole 3*eh* which is in air communication with the inside of the cabinet 1, is formed in the back surface frame 3*e*. The first magnetic circuit 5*e* is fixed to a center portion of a bottom surface (the inner portion) of the back surface frame 3*e*. The second magnetic circuit 6*e* is positioned, facing the first magnetic circuit 5*e* via the column 16*e*. The first and second magnetic circuits 5*e* and 6*e* have a cylindrical outer shape. The second magnetic circuit 6*e* is disposed at a position which allows a center axis thereof coincides with a center axis of the first magnetic circuit 5*e*. The non-magnet member 15*e* is a ring-shaped plate and is a magnetic member which does not include a magnet. The non-magnet member 15*e* is disposed in a gap between the first magnetic circuit 5*e* and the second magnetic circuit 6*e*. Note that the column 16*e* is positioned at an open hole of an inner circumferential portion of the non-magnet member 15*e*. The first voice coil bobbin 10*e* is a cylindrical member which is fixed to a surface facing the first magnetic circuit 5*e* of the non-magnet member 15*e*. The first voice coil 11*e* is wound around an outer circumferential surface of the first voice coil bobbin 10*e*. The second voice coil bobbin 12*e* is a cylindrical member, one end of which is fixed to a surface facing the second magnetic circuit 6*e* of the non-magnet member 15*e*. The second voice coil 13*e* is wound around an outer circumferential surface at the other end of the second voice coil bobbin 12*e*. An inner circumference of the diaphragm 9*e* is fixed to the other end of the second voice coil bobbin 12*e*. An outer circumference of the edge 7*e* is fixed to the vicinity of an outer circumference of the back surface frame 3*e*. An inner circumference of the edge 7*e* is fixed to an outer circumference of the diaphragm 9*e*. Note that the diaphragm 9*e* and the edge 7*e* may be integrated together. An outer circumference of the damper 8*e* is fixed to the back surface frame 3*e*. An inner circumference of the damper 8*e* is fixed to the outer circumference of the diaphragm 9*e*. In the speaker unit 2*e*, the diaphragm 9*e*, the first and second voice coil bobbins, the non-magnet member 15*e*, and the first and second voice coils are vibration system members which are vibrated by an input electrical signal. The edge 7*e* and the damper 8*e* are support system members which support the vibration system members in a manner which allows the non-magnet member 15*e* to vibrate in the gap between the first magnetic circuit 5*e* and the second magnetic circuit 6*e*. A dust cap 14*e* is a portion of the diaphragm 9*e*.

The first magnetic circuit 5*e* has a yoke 51*e*, a magnet 54*e*, and a magnetic plate 53*e*. The magnetic plate 53*e* is in the shape of a cylinder and is fixed to a center portion of a bottom surface of the back surface frame 3*e*. The magnet 54*e* is in the shape of a cylinder and is fixed to a front surface of the magnetic plate 53*e*. The yoke 51*e* is in the shape of a ring, and is fixed to a front surface of the back surface frame 3*e* so that the magnetic plate 53*e* and the magnet 54*e* are disposed in an inner circumference thereof. A gap is formed between an outer circumferential surface of each of the magnetic plate 53*e* and the magnet 54*e*, and an inner cylindrical surface of the yoke 51*e*. A magnetic gap is formed between the outer circumferential surface of the magnetic plate 53*e* and the inner circumferential surface of the yoke 51*e*. Note that the magnet 54*e* is magnetized in a vibration direction (an x-axis direction) of the diaphragm 9*e* and the non-magnet member 15*e*. The first voice coil 11*e* is disposed in the magnetic gap formed in the first magnetic circuit 5*e*, by the first voice coil bobbin 10*e* fixed to the non-magnet member 15*e*.

The second magnetic circuit 6*e* has a yoke 61*e*, a magnetic plate 63*e*, and a magnet 64*e*. The yoke 61*e* is a ring-shaped yoke whose an outer circumferential surface is fixed to the back surface frame 3*e*. The magnet 64*e* is in the shape of a cylinder, and is fixed to the column 16*e* fixed to the magnet 54*e*. Specifically, the magnet 64*e* is positioned, facing the magnet 54*e* by means of the column 16*e*. The magnetic plate 63*e* is in the shape of a cylinder, and fixed to a front surface of the magnet 64*e*. A gap through which the second voice coil bobbin 12*e* can penetrate is formed between an outer circumferential surface of each of the magnetic plate 63*e* and the magnet 64*e*, and an inner circumferential surface of the yoke 61*e*. In the gap, a magnetic gap is formed between the outer circumferential surface of the magnetic plate 63*e* and the inner circumferential surface of the yoke 61*e*. Note that the magnet 64*e* is magnetized in a vibration direction of the diaphragm 9*e* and the non-magnet member 15*e*. The second voice coil 13*e* is disposed in the magnetic gap formed in the second magnetic circuit 6*e*, by the second voice coil bobbin 12*e* fixed to the non-magnet member 15*e*.

Here, the magnetization directions of the magnet 54*e* and the magnet 64*e*, and the winding directions of the first and second voice coils, will be described. When the magnet 54*e* and the magnet 64*e* are caused to have the same magnetization direction, the winding directions of the first and second voice coils are set to be opposite to each other. When the magnetization direction of the magnet 54*e* and the magnet 64*e* are caused to be opposite to each other, the winding directions of the first and second voice coils are set to be the same. Thereby, when a current is applied to the first and second voice coils, driving forces are obtained in the same direction.

The non-magnet member 15*e* is a ring-shaped plate and is a magnetic material other than magnets. The non-magnet member 15*e* may be disposed in a gap between the first and second magnetic circuits. Therefore, for example, the non-magnet member 15*e* may have a shape corresponding to the circular shape of the yoke 51*e* or the yoke 61*e*. An area obtained by projecting the gap formed between the first and second magnetic circuits perpendicularly onto the non-magnet member 15*e* is in the shape of a ring. A magnetic field in the vicinity of the ring-shaped area can generate a repelling force most strongly with respect to the non-magnet member 15*e*. Therefore, more preferably, the non-magnet member 15*e* corresponds to the ring-shaped area.

Next, an operation of the speaker device of this embodiment will be described. When an electrical signal is applied to the first voice coil 11*e* and the second voice coil 13*e*, a current flows through each voice coil and a magnetic field is formed in each magnetic gap, so that a driving force is generated in each voice coil in the same direction. Each driving force vibrates the diaphragm 9*e*, thereby generating sound.

The non-magnet member 15*e*, to which the first and second voice coil bobbins are fixed, vibrates in the gap between the first magnetic circuit 5*e* and the second magnetic circuit 6*e*. The vibration direction of the non-magnet member 15*e* is the front-to-back surface direction (the x-axis direction). In this case, pulling forces in the vibration direction are alternately applied to the non-magnet member 15*e* by the magnetic field formed by the first and second magnetic circuits, depending on the vibration of the non-magnet member 15*e*. In other words, in this embodiment, the non-magnet member 15*e*, the first magnetic circuit 5*e*, and the second magnetic circuit 6*e* play a role as a negative stiffness generating mechanism. Note that the negative stiffness generating mechanism is similar to that of the first embodiment above and will not be described. By the negative stiffness generating mechanism, the suppression by the acoustic stiffness of the empty room enclosed by the cabinet 1, the diaphragm 9*e*, and the edge 7*e* is relaxed, so that non-magnet member 15*e* and the diaphragm 9*e* become easy to vibrate. Specifically, the diaphragm 9*e* operates as if the cabinet volume were large, so that the minimum resonant frequency of the speaker unit 2*e* is reduced. As a result, the limit of low-frequency sound reproduction can be expanded.

As described above, the negative stiffness generating mechanism relaxes the influence of the acoustic stiffness of the empty room enclosed by the cabinet 1, the diaphragm 9*e*, and the edge 7*e*. Thereby, the speaker device of this embodiment, even in the case of a small-size cabinet, operates as if the cabinet volume were large, so that the limit of low-frequency sound reproduction can be expanded.

In this embodiment, there is not a frame in front of the diaphragm 9*e*, so that sound quality is not inhibited, as compared to the second embodiment above.

In the speaker unit 2*e* of this embodiment, the first and second magnetic circuits are symmetric about the non-magnet member 15*e* as in the second embodiment above. Thereby, in the gap between the first and second magnetic circuits, a symmetric magnetic field distribution is formed in the vibration direction from the balanced position of the gap. Therefore, a distortion due to the asymmetry of a magnetic field distribution can be reduced.

Note that, in this embodiment, the magnetic plate 53*e*, the first voice coil bobbin 10*e*, and the voice coil 11*e* may be eliminated. Also, the magnetic plate 63*e* and the second voice coil 13*e* may be eliminated. In this case, the second voice coil bobbin 12*e* plays a role as a connection member for connecting the non-magnet member 15*e* and the diaphragm 14*e*. In this case, as compared to the speaker unit 2*e* of this embodiment, the number of magnet components can be reduced, resulting in an advantage in terms of cost.

Although the speaker unit 2*e* is in the shape of, for example, a circle in this embodiment, the speaker unit 2*e* may have other shapes, such as an elliptical shape, a track shape, a rectangular shape, an elongate shape, or the like, as in the first embodiment above. The shapes of the parts (e.g., a magnet, etc.) included in each speaker unit are similar to those of the first embodiment above.

Fourth Embodiment

Figure 6:
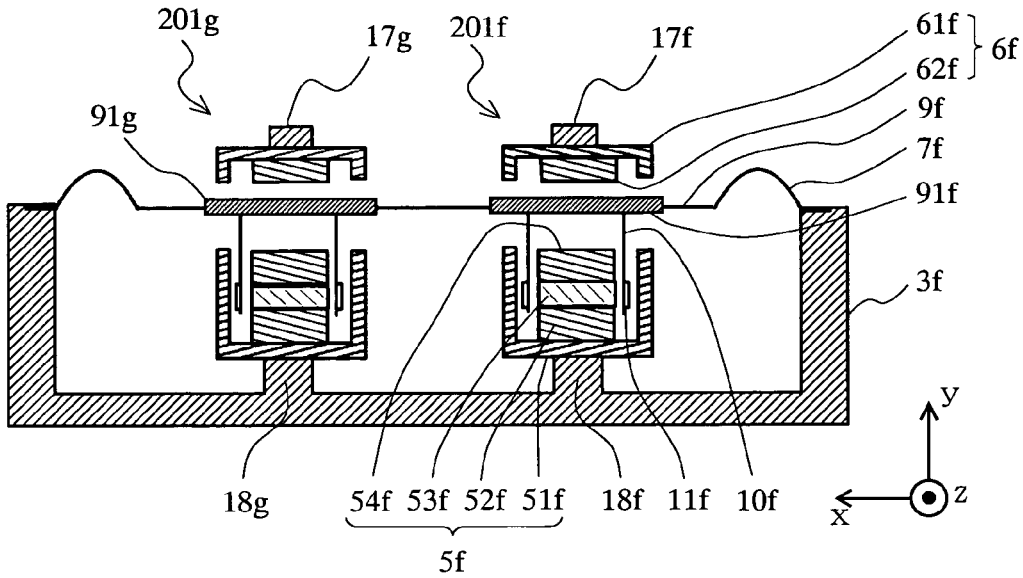
FIG. 6 is a cross-sectional view of a structure of a speaker device according to a fourth embodiment.
Figure 7:
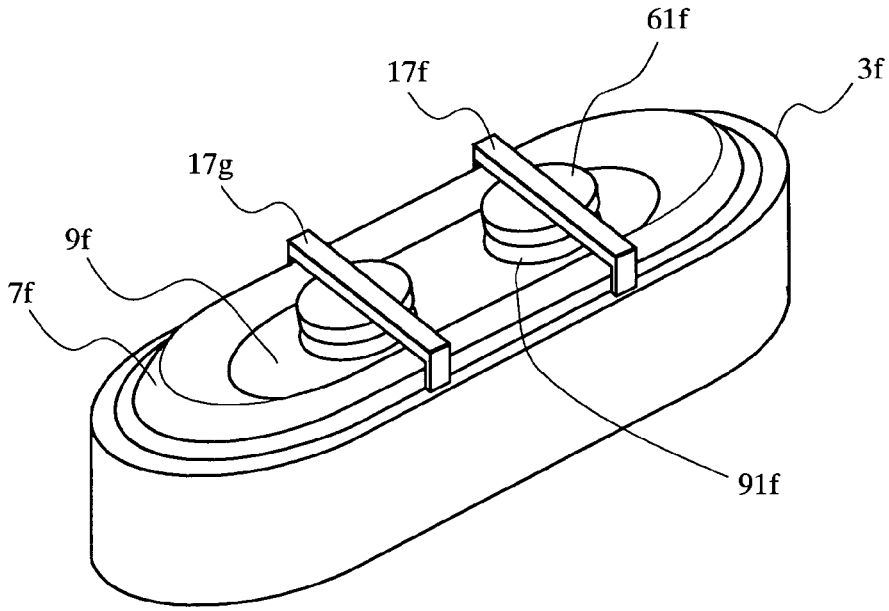
FIG. 7 is a perspective view of the speaker device of the fourth embodiment.

A speaker device according to a fourth embodiment of the present invention will be described with reference to FIGS. 6 and 7. FIG. 6 is a cross-sectional view of a structure of the speaker device of the fourth embodiment. FIG. 7 is a perspective view of the speaker device of the fourth embodiment.

In FIG. 6, the speaker device of the fourth embodiment roughly comprises a back surface frame 3*f*, a drive portion 201*f*, a drive portion 201*g*, an edge 7*f*, a diaphragm 9*f*, an arm 17*f*, and an arm 17*g*. The back surface frame 3*f* is a housing in which an opening portion is formed at an upper surface thereof (the positive direction of a y axis). The drive portion 201*f* is fixed to a convex guide 18*f* formed inside the back surface frame 3*f*. The drive portion 201*g* is fixed to another guide 18*g*. Note that the drive portion 201*g* has a configuration similar to that of the drive portion 201*f* and will not be described in detail. The diaphragm 9*f* is used in common by the drive portions 201*f* and 201*g*, and has a track shape. At least a portion of the diaphragm 9*f* is composed of a non-magnet member 91*f* and a non-magnet member 91*g*. An outer circumference of the edge 7*f* is fixed to the opening portion formed at the upper surface of the back surface frame 3*f*. An inner circumference of the edge 7*f* is fixed to an outer circumference of the diaphragm 9*f*. Note that the diaphragm 9*f* and the edge 7*f* may be integrated together. The back surface frame 3*f* may have a track shape as viewed from the top as illustrated in FIG. 7, for example. The back surface frame 3*f* is a housing which gives an acoustic stiffness to the drive portions 201*f* and 201*g*. This embodiment is different from the above-described first to third embodiments in that a frame serves as a housing which gives an acoustic stiffness instead of a cabinet, and that a plurality of magnetic circuits (drive portions) to drive a diaphragm at a number of points. Hereinafter, a structure of the drive portion 201*f* will be mainly described.

The drive portion 201*f* has a first magnetic circuit 5*f*, a second magnetic circuit 6*f*, a voice coil bobbin 10*f*, and a voice coil 11*f*. The first magnetic circuit 5*f* is fixed to the convex guide 18*f* formed inside the back surface frame 3*f*. The arm 17*f* is in the shape of an arch, and is fixed to the back surface frame 3*f*. The second magnetic circuit 6*f* is fixed to the arm 17*f*, and is positioned, facing the first magnetic circuit 5*f*. A center axis on a surface facing the first magnetic circuit 5*f* of the second magnetic circuit 6*f* coincides with a center axis of the first magnetic circuit 5*f*. The voice coil bobbin 10*f* is a cylindrical member which is fixed to a surface facing the first magnetic circuit 5*f* of the non-magnet member 91*f*. The voice coil 11*f* is wound around an outer circumferential surface of the voice coil bobbin 10*f*. Here, the diaphragm 9*f* is disposed in a gap between the first and second magnetic circuits of each of the drive portions 201*f* and 201*g*. In this embodiment, the diaphragm 9*f*, the non-magnet members 91*f* and 91*g*, the voice coil bobbin 10*f* and the voice coil 11*f*, and the voice coil bobbin 10*f* and the voice coil 11*f* of the drive portion 201*g* are vibration system members which are vibrated by an input electrical signal. The edge 7*f* is a support system member which supports the vibration system members in a manner which allows the non-magnet member 91*f* and the non-magnet member 91*g* to vibrate in the gap between the first magnetic circuit and the second magnetic circuit.

The first magnetic circuit 5*f* has a yoke 51*f*, a first magnet 52*f*, a magnetic plate 53*f*, and a second magnet 54*f*. The yoke 51*f* has a cylindrical side surface, a bottom surface which is formed at one end of the side surface, and an opening at the other end. The yoke 51*f* is fixed to the convex guide 18*f* formed inside the back surface frame 3*f*. The first magnet 52*f* is in the shape of a cylinder, and is fixed to a center portion of an upper surface of the yoke 51*f*. The magnetic plate 53*f* is in the shape of a cylinder, and is fixed to an upper surface of the first magnet 52*f*. The second magnet 54*f* is in the shape of a cylinder, and is fixed to an upper surface of the magnetic plate 53*f*. A gap is formed between an outer circumferential surface of each of the first magnet 52*f*, the magnetic plate 53*f*, and the second magnet 54*f*, and an inner circumferential surface of the yoke 51*f*. In the gap, a magnetic gap is formed between the outer circumferential surface of the magnetic plate 53*f* and the inner circumferential surface of the yoke 51*f*. Note that the voice coil 11*f* is disposed in the magnetic gap by the voice coil bobbin 10*f* fixed to the non-magnet member 91*f*. The first magnet 52*f* and the second magnet 54*f* are each magnetized in a vibration direction of the diaphragm 9*f*. The magnetization directions of the first magnet 52*f* and the second magnet 54*f* are opposite to each other.

Here, a magnetic flux of the second magnet 54*f* passes via the magnetic plate 53*f* through the magnetic gap. Also, since the second magnet 54*f* is magnetized in a direction which causes the second magnet 54*f* to repel the first magnet 52*f*, the magnetic flux of the first magnet 52*f* passes through the magnetic gap in a further concentrated manner. In other words, the second magnet 54*f* increases the magnetic flux density in the magnetic gap to increase a driving force of the first voice coil 11*f*.

The second magnetic circuit 6*f* has a yoke 61*f* and a magnet 62*f*. The yoke 61*f* has a circular bottom surface and a cylindrical side surface. An opening portion is formed at a side opposite to the circular bottom surface. The yoke 61*f* is fixed to the arm 17*f*. The magnet 62*f* is in the shape of a cylinder, and is fixed to a center portion of the bottom surface of the yoke 61*f*. Here, as in the first magnetic circuit 5*f*, a gap is formed between an outer circumferential surface of the magnet 62*f* and an inner circumferential surface of the yoke 61*f*. Note that the magnet 62*f* is magnetized in a vibration direction (a y-axis direction) of the diaphragm 9*f*. The magnetization direction the magnet 62*f* may be the same as or opposite to that of the second magnet 54*f*.

The diaphragm 9*f* is used in common by the drive portions 201*f* and 201*g*, and has a track shape. At least a portion of the diaphragm 9*f* is composed of the non-magnet member 91*f* and the non-magnet member 91*g*. In FIG. 6, the non-magnet member 91*f* and 91*g* are, for example, circular plates joined with the diaphragm 9*f* so that the non-magnet members 91*f* and 91*g* are disposed in a gap between the first and second magnetic circuits of the respective drive portions 201*f* and 201*g*. Note that an area obtained by projecting the gap formed between the first and second magnetic circuits perpendicularly onto the diaphragm 9*f* is in the shape of a ring. A magnetic field in the vicinity of the ring-shaped area can generate a repelling force most strongly with respect to the non-magnet member 91*f*. Therefore, more preferably, the non-magnet member 91*f* corresponds to the ring-shaped area. Also, for example, the non-magnet member 91*f* may correspond to the circular shape of the yoke 51*f* or the yoke 61*f*. The non-magnet member 91*g* is similar to the non-magnet member 91*f*. Also, for example, an entire surface of the diaphragm 9*f* may be composed of the non-magnet member 91*f*.

Next, an operation of the speaker device of this embodiment will be described. When an electrical signal is applied to the voice coil 11*f* in the drive portion 201*f*, a current flows through the voice coil 11*f* and a magnetic field is formed in the magnetic gap, so that a driving force is generated. The driving force vibrates the diaphragm 9*f*, thereby generating sound. The drive portion 201*g* also vibrates the diaphragm 9*f* in a manner similar to that of the drive portion 201*f*. Hereinafter, an operation of the drive portion 201*f* will be described.

The diaphragm 9*f* including the non-magnet member 91*f* vibrates in the gap between the first magnetic circuit 5*f* and the second magnetic circuit 6*f*. The vibration direction of the diaphragm 9*f* includes upward and downward directions (the y-axis direction). In this case, pulling forces in the vibration direction are alternately applied to the non-magnet member 91*f* by the magnetic field formed by the first and second magnetic circuits, depending on the vibration of the diaphragm 9*f*. In other words, in this embodiment, the non-magnet member 91*f*, the first magnetic circuit 5*f*, and the second magnetic circuit 6*f* play a role as a negative stiffness generating mechanism. In the drive portion 201*g*, the non-magnetic member 91*g*, and counterparts of the first and second magnetic circuits play a role as a negative stiffness generating mechanism. The negative stiffness generating mechanism is similar to that of the first embodiment above and will not be described. By the negative stiffness generating mechanism, the suppression by the acoustic stiffness of the empty room enclosed by the back surface frame 3*f*, the diaphragm 9*f*, and the edge 7*f* is relaxed, so that the drive portions

201*f* and 201*g* become easy to vibrate. Specifically, the diaphragm 9*f* operates as if the cabinet volume were large, so that the minimum resonant frequencies of the drive portions 201*f* and 201*g* are reduced. As a result, the limit of low-frequency sound reproduction can be expanded.

As described above, the negative stiffness generating mechanism relaxes the influence of the acoustic stiffness of the empty room enclosed by the back surface frame 3*f*, the diaphragm 9*f*, and the edge 7*f*. Thereby, the speaker device of this embodiment, even in the case of a small-size cabinet, operates as if the cabinet volume were large, so that the limit of low-frequency sound reproduction can be expanded.

Also, in this embodiment, the track-shaped diaphragm 9*f* is driven at two points by the drive portions 201*f* and 201*g*. Here, when a diaphragm has a shape in which not every point on the outer circumference thereof is equally distant from the center of gravity thereof (e.g., a track shape, an elliptical shape, etc.), divided resonance is likely to occur. Therefore, it is necessary to use a diaphragm having a cone shape or the like so as to increase the stiffness of the diaphragm. However, in the case of, for example, a thin speaker, since the depth of the cone shape cannot be increased, it is difficult to increase the stiffness. According to this embodiment, for example, by disposing the drive portions 201*f* and 201*g* for driving the diaphragm 9*f* at positions which correspond to nodes of the divided resonance, the divided resonance can be suppressed even when the stiffness of the diaphragm 9*f* is not high. Therefore, even in the case of a cone-shaped diaphragm, the divided resonance can be suppressed, thereby making it possible to achieve a thinner speaker.

Also, in this embodiment, the drive portion 201*f* and 201*g* each include one voice coil, and may include an additional voice coil. In this case, a magnetic plate and a magnet are added so that a magnetic gap is formed in the second magnetic circuit 6*f* and the second magnetic circuit of the drive portion 201*g*. Thereby, the driving forces of the drive portions 201*f* and 201*g* are increased, thereby making it possible to improve the output sound pressure level.

Although the diaphragm 9*f* is driven at two points by the drive portions 201*f* and 201*g* in this embodiment, a speaker unit(s) may be added so to provide three or more driving points. Also, the diaphragm 9*f* and the back surface frame 3*f* may be in the shape of a rectangle, an ellipse, or the like. Also, the yoke, the magnetic plate, the magnet, and the like are not limited to the cylindrical shape, and may have other appropriate shapes (e.g., a rectangular prism, etc.). Also, the first and second magnetic circuits of this embodiment may have the configuration of any of the magnetic circuits of the first to third embodiments.

Fifth Embodiment

Figure 8:
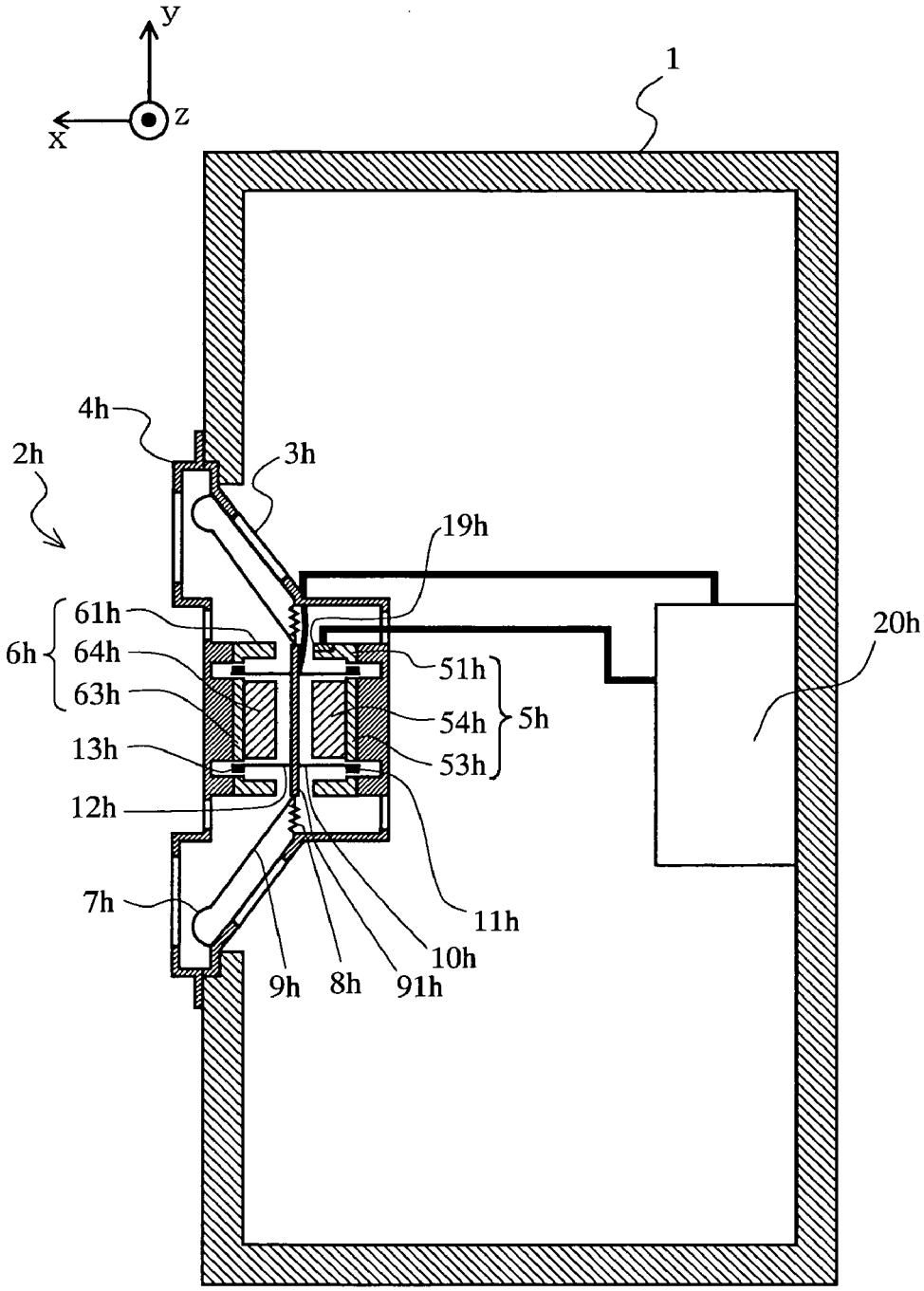
FIG. 8 is a cross-sectional view of a structure of a speaker device according to a fifth embodiment.

A speaker device according to a fifth embodiment of the present invention will be described with reference to FIG. 8. FIG. 8 is a cross-sectional view of a structure of the speaker device of the fifth embodiment. In FIG. 8, the speaker device of the fifth embodiment roughly comprises a cabinet 1, a speaker unit 2*h*, and a control circuit 20*h*. This embodiment is different from the above-described first to fourth embodiments in that a laser displacement gauge and a control circuit are additionally provided.

The speaker unit 2*h* is attached to an opening portion formed in the front surface of the cabinet 1. The speaker unit 2*h* has a back surface frame 3*h*, a front surface frame 4*h*, a first magnetic circuit 5*h*, a second magnetic circuit 6*h*, an edge 7*h*, a damper 8*h*, a diaphragm 9*h*, a first voice coil bobbin 10*h*, a first voice coil 11*h*, a second voice coil bobbin 12*h*, a second voice coil 13*h*, and a laser displacement gauge 19*h*.

The speaker unit 2*h* has a structure different from that of the speaker unit 2*d* of FIG. 4 only in shapes of the back surface frame 3*h*, the front surface frame 4*h*, a yoke 51*h*, a yoke 61*h*, and will not be described in detail. Also, the speaker unit 2*h* is different from the speaker unit 2*d* in that the laser displacement gauge 19*h* is disposed in the speaker unit 2*h*. Hereinafter, these differences will be mainly described with reference to FIGS. 8 and 9. Note that FIG. 9 is a circuit block diagram of the speaker device of the fifth embodiment.

Figure 9:
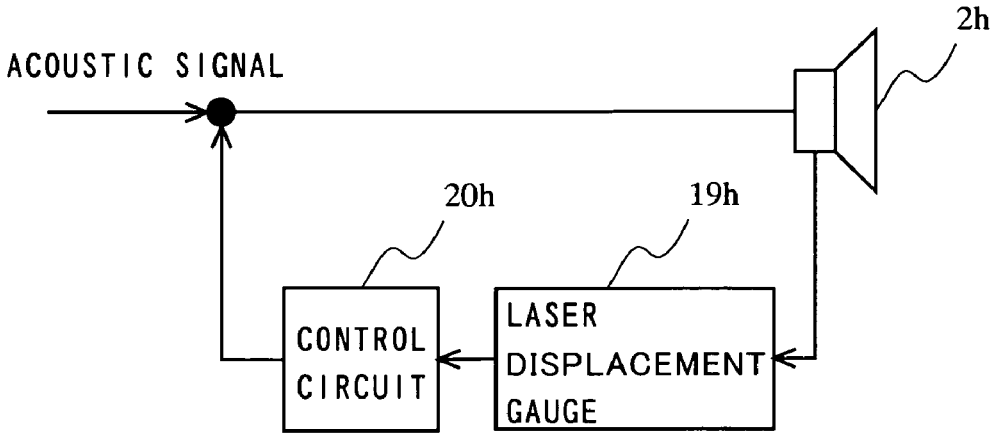
FIG. 9 is a circuit block diagram of the speaker device of the fifth embodiment.

In FIG. 9, the laser displacement gauge 19*h* detects a displacement of the diaphragm 9*h*, and outputs the detection signal to the control circuit 20*h*. Also, in FIG. 8, the laser displacement gauge 19*h* is disposed at the yoke 51*h* and is connected to the control circuit 20*h* via a conductor. Note that the position of the laser displacement gauge 19*h* is not limited to the yoke 51*h*, and the laser displacement gauge 19*h* may be disposed at a position, such as the front surface frame 4*h*, the cabinet 1, or the like, which allows it to detect the displacement of the diaphragm 9*h*. Although a laser displacement gauge is used to detect the displacement of the diaphragm 9*h*, a small-size magnet may be fixed to the diaphragm 9*h* and a Hall element may be used to detect a position of the diaphragm 9*h*.

In FIG. 9, the control circuit 20*h* generates a control signal which causes a center of an amplitude of a non-magnet member 91*h* to be at a balanced position in a gap between the first and second magnetic circuits, based on the displacement of the diaphragm 9*h* detected by the laser displacement gauge 19*h*. The control signal generated in the control circuit 20*h* is added to an input acoustic signal. The input acoustic signal and the control signal are amplified as appropriate by an amplifier or the like before being applied to the speaker unit 2*h*. Note that the control signal is, for example, a direct current electrical signal which corrects a deviation of the non-magnet member 91*h* from the balanced position. Also, in FIG. 8, the control circuit 20*h* is provided inside the cabinet, and is connected via conductors to an input terminal and the laser displacement gauge 19*h* of the speaker unit 2*h*. Note that the control circuit 20*h* may be disposed outside the cabinet.

In the speaker unit 2*h*, the principle of driving the diaphragm 9*h* and the principle of generating a negative stiffness are similar to those of the above-described speaker unit 2*d*. By the negative stiffness generating mechanism, a repelling force is applied to the non-magnet member 91*h* in a direction which causes the non-magnet member 91*h* to go away from the balanced position. Here, the case where temperature is increased inside the cabinet 1. The first voice coil 11*h* and the second voice coil 13*h* generate heat when a current flows therethrough. When the temperature inside the cabinet 1 is increased due to heat generation of the first and second voice coils, the air inside the cabinet 1 is expanded or contracted, so that the inside pressure is changed. Due to the pressure change, a force is applied to the diaphragm 9*h*, so that the center of the amplitude of the non-magnet member 91*h* is deviated from the balanced position. The repelling force is symmetric about the balanced position as a reference in the vibration direction. Therefore, when the center of the amplitude of the non-magnet member 91*h* is deviated from the balanced position, the symmetry of the repelling force is extremely disrupted, so that a large distortion occurs in reproduced sound. When the deviation from the balanced position becomes large, the diaphragm 9*h* remains pulled by the first magnetic circuit 5*h* or the second magnetic circuit 6*h* and cannot vibrate. However, in this embodiment, the control circuit 20*h* generates a control signal which causes the center of the amplitude of the non-magnet member 91*h* to be at the balanced position, and adds the control signal to the input acoustic signal. Thereby, the diaphragm 9*h* can be stably operated with the center of the amplitude of the non-magnet member 91*h* being at the balanced position, irrespective of a change in surrounding environments, such as a change in temperature or the like. Therefore, sound can be reproduced with a less distortion. Although the speaker unit 2*h* is used in the speaker device of this embodiment, the speaker units of the first to fourth embodiments may be used.

Figure 10:
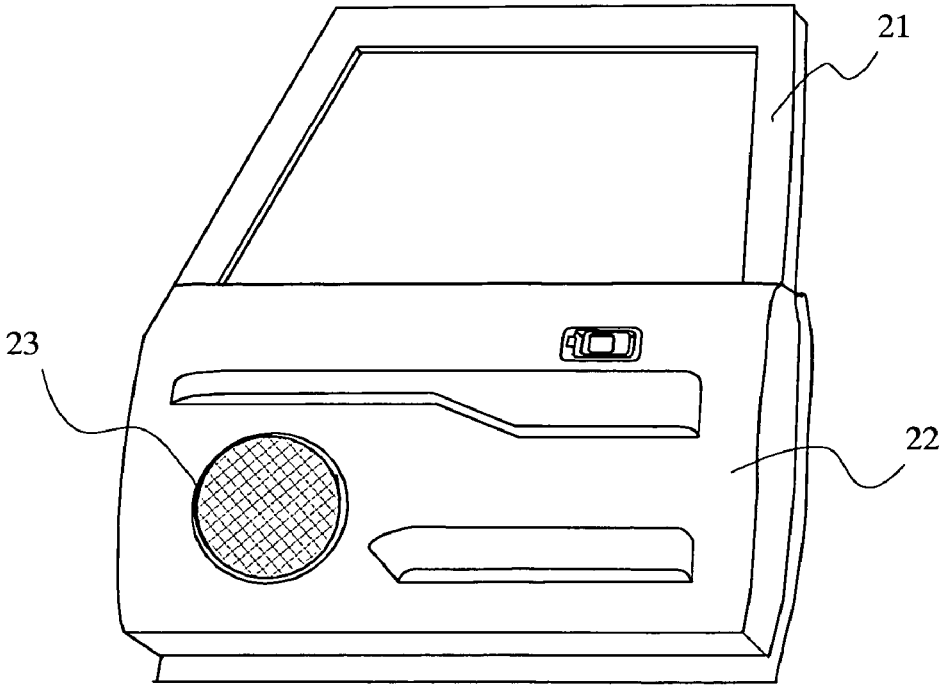
FIG. 10 is a diagram illustrating an example in which a speaker unit is provided in a car door.

Note that the speaker devices of the first to fifth embodiments are disposed inside the body of a car, as an example. For example, the speaker device is provided in a door of the car. FIG. 10 is a diagram illustrating an example in which a speaker unit is provided in a car door.

In FIG. 10, the car door is composed of a window portion 21, a door main body 22, and a speaker unit 23. Here, the speaker unit 23 is, for example, the speaker unit of any of the above-described first to fifth embodiments, and will not be described. The speaker unit 23 is attached inside the door main body 22. A space is formed inside the door main body 22. In other words, the door main body 22 serves as a cabinet for the speaker unit 23. Therefore, the speaker unit 23 and the main body 22 constitute a speaker device. Thus, by applying the speaker unit 23 to a car door, it is possible to provide an in-car listening environment in which a low-frequency sound reproduction band is expanded even when the door main body 22 is a conventional one.

Also, a window glass storing portion, an automatic window opening/closing mechanism, a door lock, wires, a control circuit, and the like are provided inside the door main body 22, the internal volume of the door main body 22 is limited. Even in the case of car doors, in which the internal volume is limited, it is possible to reproduce a lower frequency band as compared to when conventional speaker units are employed.

Figure 11:
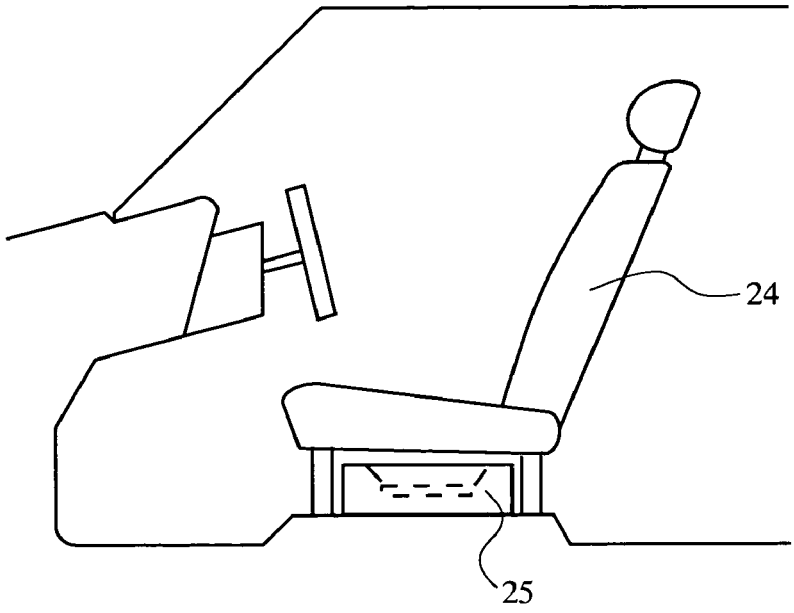
FIG. 11 is a diagram illustrating an exemplary speaker device which is provided inside a car.

The speaker devices of the first to fifth embodiments may be disposed inside the body of a car, for example. FIG. 11 is a diagram illustrating an exemplary speaker device which is disposed inside a car. In FIG. 11, for example, a speaker device 25 is provided under a seat 24. Here, the speaker device 25 is any of the speaker devices of the first to fifth embodiments, and will not be described in detail. Thus, by providing the speaker device 25 into a car, it is possible to provide an in-car listening environment in which a low-frequency sound reproduction band is expanded even when the cabinet volume is the same as the conventional one.

Also, when it is aimed to achieve low-frequency sound reproduction to the same level as that of the conventional art, the cabinet of the speaker device 25 can be further reduced as compared to the conventional art. By providing the speaker device 25 in a car, a larger space can be secured in the car. The present invention is particularly effective for low-frequency sound speaker devices, such as a subwoofer and the like, which generally require a large volume cabinet.

Figure 12:
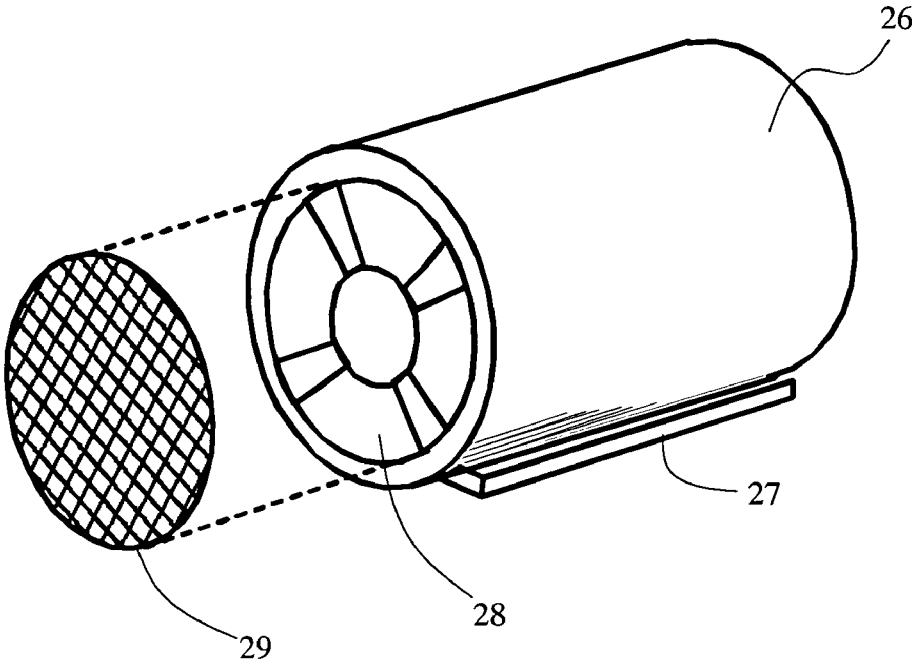
FIG. 12 is a diagram illustrating another exemplary speaker device which is provided inside a car.

Also, the speaker devices of the first of seventh embodiments may be an in-car speaker device illustrated in FIG. 12. FIG. 12 is a diagram illustrating another exemplary speaker device which is provided inside a car. In FIG. 12, the speaker device comprises a cabinet 26, a pedestal 27, a speaker unit 28, and a punching net 29. Here, the speaker unit 28 is any of the speaker units of the above-described first to fifth embodiments, and will not be described in detail. Thus, by providing the speaker device of FIG. 12 inside a car, it is possible to provide an in-car listening environment in which a low-frequency sound reproduction band is expanded even when the cabinet volume is the same as the conventional one.

Also, when it is aimed to achieve low-frequency sound reproduction to the same level as that of the conventional art, the cabinet of the speaker device can be further reduced as compared to the conventional art. Therefore, by providing the speaker device in a car, a larger space can be secured in the car. The present invention is particularly effective for low-frequency sound speaker devices, such as a subwoofer and the like, which generally require a large volume cabinet. Note that the shape of the cabinet 26 is not limited to the cylindrical shape of FIG. 12, and may be a cuboidal shape or the like.

Also, the speaker devices of the first to fifth embodiments are provided in, for example, AV systems and the like. As an example, the speaker devices of the first to fifth embodiments are provided in video devices (e.g., cathode-ray tube televisions, liquid crystal televisions, plasma televisions, etc.).

Figure 13:
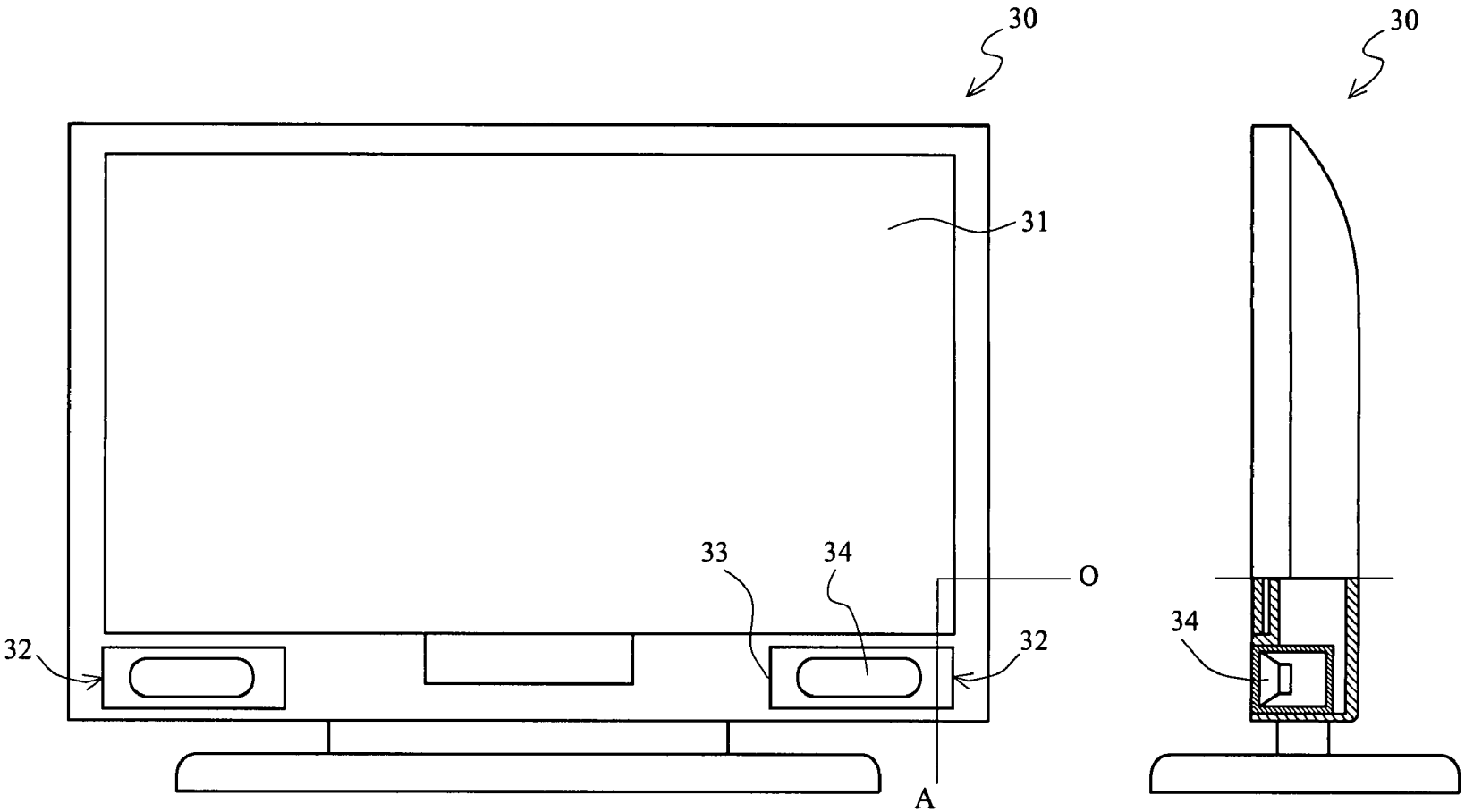
FIG. 13 is a diagram illustrating an exemplary configuration in which a speaker device is provided in a thin television.
Figure 14:
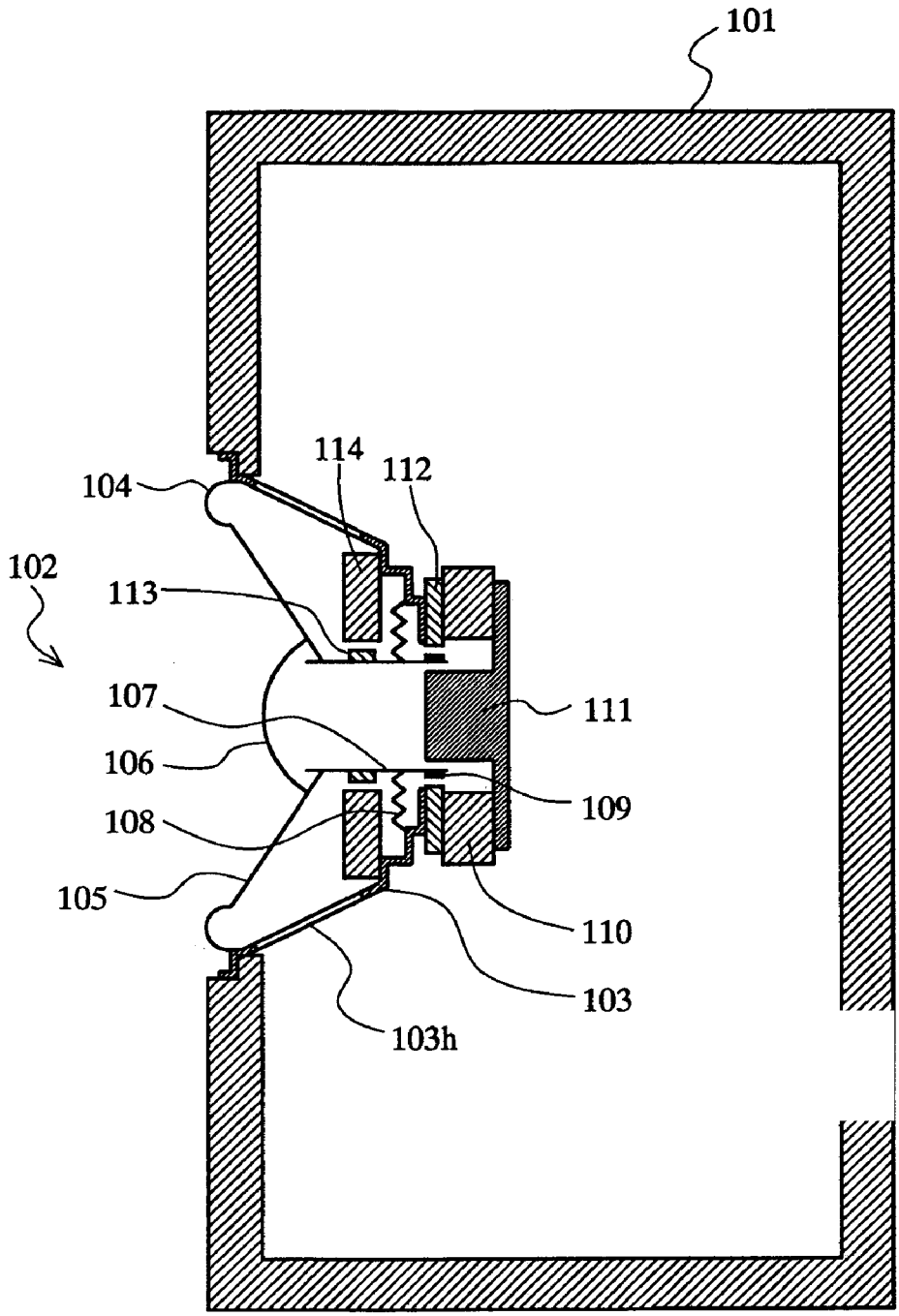
FIG. 14 PRIOR ART
FIG. 14 is a cross-sectional view of a structure of a conventional speaker device.

FIG. 13 is a diagram illustrating an exemplary configuration in which the above-described speaker device is provided in a thin television. FIG. 13 illustrates a front view of the thin television, and a cross-sectional, side view, partially taken along line O-A. In FIG. 13, the thin television comprises a thin television main body 30, a display 31, and two speaker devices 32. The speaker device 32 is any of the speaker devices of the first to fifth embodiments and will not be described in detail.

A cabinet 33 of the speaker device 32 is disposed inside a housing provided below the display 31. A speaker unit 34 is, for example, an elliptical speaker unit, which is attached to the cabinet 33. Thus, by providing the speaker device of the present invention to the thin television main body 30, it is possible to provide a listening environment in which a low-frequency sound reproduction band is expanded even when the cabinet volume is the same as the conventional one.

Also, in the thin television main body 30, when it is aimed to achieve low-frequency sound reproduction to the same level as that of the conventional art, the cabinet 33 of the speaker device 32 can be further reduced as compared to the conventional art. Therefore, in the case where a smaller space for a speaker device is required when the thin television main body 30 is further thinned or miniaturized, by providing the speaker device 32, the thin television main body 30 can be thinned or miniaturized. Although the cabinet 33 of the speaker device 32 of FIG. 13 is attached below the display 31, the cabinet 33 may be disposed on both sides of the display 31.

The speaker device of the present invention can reproduce a low-frequency sound band even when the cabinet volume is small, and can be applied to applications, such as speaker devices for liquid crystal televisions or PDPs (plasma displays), audio devices, and 5.1-channel reproduction home theaters, in-car speakers, and the like.

The invention claimed is:

1. A speaker device comprising:

a housing having an opening portion;

a vibration system member vibrating to generate sound;

a support system member connected to said housing and for supporting said vibration system member in a manner which allows said vibration system member to vibrate;

a first magnetic circuit disposed inside said housing and having a first magnet provided on a surface thereof facing the opening portion, and a first yoke provided lateral to the first magnet; and a second magnetic circuit having a second magnet disposed facing the first magnet of said first magnetic circuit via a first magnetic gap, and a second yoke provided lateral to the second magnet, wherein a second magnetic gap is formed in at least one of an interval between a side surface of the first magnet and the first yoke in said first magnetic circuit and an interval between a side surface of the second magnet and the second yoke in said second magnetic circuit, said vibration system member includes:

a first voice coil;

a first voice coil bobbin provided to dispose the first voice coil in the second magnetic gap; and a diaphragm including a magnetic member, the magnetic member being made of a magnetic material other than a magnet, being connected directly or indirectly to the first voice coil bobbin and being disposed in the first magnetic gap between the first magnet of said first magnetic circuit and the second magnet of said second magnetic circuit, wherein when said vibration system member is displaced to said first magnetic circuit from a balanced position, the magnetic member receives a pulling force in a direction which causes the magnetic member to travel away from the balanced position by the magnetic field formed by said first magnetic circuit and when said vibration system member is displaced to said second magnetic circuit from a balanced position, the magnetic member receives a pulling force in a direction which causes the magnetic member to travel away from the balanced position by the magnetic field formed by said second magnetic circuit.

2. The speaker device according to claim 1, wherein the first voice coil bobbin is fixed to the diaphragm, and said support system member supports the diaphragm in the first magnetic gap in a manner which allows the diaphragm to vibrate.

3. The speaker device according to claim 1, wherein said second magnetic circuit further includes:

a magnetic plate fixed to a surface facing the opening portion of the second magnet, the second yoke is disposed lateral to the second magnet and the magnetic plate, and forms the second magnetic gap between the second magnet and a side surface of the magnetic plate, said diaphragm is disposed so as to face a surface facing the opening portion of said housing of said second magnetic circuit, the first voice coil bobbin connects the diaphragm and the magnetic member via the second magnetic gap formed in said second magnetic circuit, and the first voice coil is disposed in the second magnetic gap formed in said second magnetic circuit.

4. The speaker device according to claim 3, wherein said first magnetic circuit further includes a magnetic plate fixed to a surface facing inside of said housing of the first magnet, the first yoke is disposed lateral to the first magnet and the magnetic plate, and forms the second magnetic gap between the first magnet and a side surface of the magnet plate, and said vibration system member further includes:

a second voice coil; and a second voice coil bobbin fixed to the magnetic member and for disposing the second voice coil in the second magnetic gap formed in said first magnetic circuit.

5. The speaker device according to claim 1, wherein said second magnetic circuit further includes:

a magnetic plate fixed to a surface facing the opening portion of the second magnet, the second yoke is disposed lateral to the second magnet and the magnetic plate, and forms the second magnetic gap between the second magnet and a side surface of the magnetic plate, said vibration system member further includes:

a connection member for connecting the diaphragm and the magnetic member via the second magnetic gap formed in the second magnetic circuit, said diaphragm is disposed so as to face a surface facing the opening portion of said housing of said second magnetic circuit, and the first voice coil bobbin disposes the first voice coil in the second magnetic gap formed in said first magnetic circuit.

6. The speaker device according to claim 1, wherein said first and second magnetic circuits have the same structure, and said second magnetic circuit and said first magnetic circuit are arranged symmetrically about the magnetic member.

7. The speaker device according to claim 6, wherein said vibration system member further includes:

a second voice coil; and a second voice coil bobbin connected directly or indirectly to the magnetic member and for disposing the second voice coil in the second magnetic gap formed in said first magnetic circuit, the first voice coil bobbin disposes the first voice coil in the second magnetic gap formed in the second magnetic circuit.

8. The speaker device according to claim 1, wherein said first magnetic circuit further includes:

a magnetic plate fixed to a surface facing inside of said housing of the first magnet; and a third magnet fixed to a surface facing inside of said housing of the magnetic plate, and the first yoke is provided to form the second magnetic gap between the first yoke and a side surface of the magnetic plate, and the first magnet and the third magnet are magnetized in directions opposite to each other, the directions being vibration directions of said vibration system member.

9. The speaker device according to claim 1, wherein said second magnetic circuit further includes:

a magnetic plate fixed to a surface facing the opening portion of said housing of the second magnet; and a third magnet fixed to a surface facing the opening portion of said housing of the magnetic plate, and the second yoke is provided to form the second magnetic gap between the second yoke and a side surface of the magnetic plate, and the second magnet and the third magnet are magnetized in directions opposite to each other, the directions being vibration directions of said vibration system member.

10. The speaker device according to claim 1, wherein said first magnetic circuit further includes:

a magnetic plate fixed to a surface facing inside of said housing of the first magnet, the first yoke is provided to form the second magnetic gap between the first yoke and a side surface of the magnetic plate, and the first magnet is magnetized in a vibration direction of said vibration system member.

11. The speaker device according to claim 1, wherein said second magnetic circuit includes:

a magnetic plate fixed to a surface facing the opening portion of the second magnet, the second yoke is provided to form the second magnetic gap between the second yoke and a side surface of the magnetic plate, and the second magnet is magnetized in a vibration direction of said vibration system member.

12. The speaker device according to claim 1, where the speaker device comprises a plurality of magnetic circuit units each composed of said first and second magnetic circuits, said vibration system member includes:

a same number of the first voice coils as a number of magnetic circuit units; and a same number of the first voice coil bobbins as the number of magnetic circuit units, each first voice coil being disposed in a corresponding second magnetic gap of the corresponding magnetic circuit unit, and said diaphragm is fixed to each first voice coil bobbin.

13. The speaker device according to claim 1, further comprising:

a position detecting section for detecting a position of said vibration system member; and a control section for controlling a vibration of said vibration system member by applying to the first voice coil a signal obtained by adding a direct current component to an acoustic signal based on the position of said vibration system member detected by the position detecting section so that a center of an amplitude of the magnetic member is at a balanced position of a magnetic field formed in the first magnetic gap.

14. The speaker device according to claim 13, wherein the position detecting section is a laser displacement gauge.

15. The speaker device according to claim 1, further comprising:

a frame fixed to said support system member, wherein a speaker unit composed of said vibration system member, said support system member, said first and second magnetic circuits, and the frame, is attached to the opening portion by the frame being fixed to the opening portion.

16. A car comprising:

the speaker device according to claim 1; and a car body inside which the speaker device is disposed.

17. A video device comprising:

the speaker device according to claim 1; and a device housing inside which the speaker device is disposed.

* * * * *